US008089359B2

(12) United States Patent
Lopez et al.

(10) Patent No.: US 8,089,359 B2
(45) Date of Patent: Jan. 3, 2012

(54) SECURITY DEVICE FOR CONSTRAINING AN ARTICLE HAVING AN ELONGATE ELEMENT

(75) Inventors: Pedro Lopez, Pompano Beach, FL (US); Dennis L. Hogan, Boca Raton, FL (US); Paul Griffiths, legal representative, Boynton Beach, FL (US); Franklin H. Valade, Jr., Fort Walton Beach, FL (US); Craig R. Szklany, Lighthouse Point, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 890 days.

(21) Appl. No.: 11/792,631

(22) PCT Filed: Dec. 7, 2005

(86) PCT No.: PCT/US2005/044524

§ 371 (c)(1), (2), (4) Date: May 27, 2008

(87) PCT Pub. No.: WO2006/063190

PCT Pub. Date: Jun. 15, 2006

(65) Prior Publication Data

US 2009/0128331 A1 May 21, 2009

Related U.S. Application Data

(60) Provisional application No. 60/633,813, filed on Dec. 7, 2004, provisional application No. 60/683,657, filed on May 23, 2005.

(51) Int. Cl.
*G08B 13/14* (2006.01)

(52) U.S. Cl. ..... 340/572.1; 340/572.8; 340/572.9

(58) Field of Classification Search .... 340/572.1–572.8, 340/568.1, 568.8, 568.5, 571, 572.9
See application file for complete search history.

(56) References Cited

U.S. PATENT DOCUMENTS 5,119,652 A * 6/1992 Costa ..... 70/57.1
5,931,031 A * 8/1999 Bouan ..... 70/57.1
2003/0160697 A1 * 8/2003 Sedon et al. ..... 340/572.9

* cited by examiner

*Primary Examiner* — Anh V La

(57) ABSTRACT

Systems and apparatus for a security device for an article having a constrained elongate member are disclosed.

27 Claims, 20 Drawing Sheets

SECURITY DEVICE FOR CONSTRAINING AN ARTICLE HAVING AN ELONGATE ELEMENT

This application claims priority to the U.S. Provisional Patent Application Ser. No. 60/633,813 titled "Improved EAS Security Tags" filed Dec. 7, 2004, and to the U.S. Provisional Patent Application Ser. No. 60/683,657 titled "Improved EAS Security Tags" filed May 23, 2005, both of which are incorporated herein by reference in their entirety.

RELATED APPLICATIONS

This international application designating the United States of America is related to the following applications designating the United States of America:

(1) "Magnetically Actuable Locking Mechanism And Associated Security Device";

(2) "Optical Disc Security Device Having A Magnetically Actuable Locking Mechanism";

(3) "Security Device Having A Cable"; and (4) "Security Device For A Bottle."

These related applications are being filed concurrently herewith and are incorporated by reference in their entirety.

BACKGROUND

A security tag system is designed to prevent unauthorized removal of an item from a controlled area. For example, a typical Electronic Article Surveillance (EAS) system may comprise a monitoring system and one or more security tags. The monitoring system may create a surveillance zone at an access point for the controlled area. A security tag may be enclosed in a security device that is secured to the monitored item, such as an article of hard goods, e.g., sporting equipment, eye wear, jewelry, bottles, and the like. If the monitored item enters the surveillance zone, an alarm may be triggered to indicate unauthorized removal.

The security device may be secured to a number of different items. It may be desirable for the security device to allow authorized release from the article, while making unauthorized release relatively difficult. Consequently, there may be a need for improved techniques in security devices in general, and systems for securing the security devices to articles in particular.

BRIEF DESCRIPTION OF THE DRAWINGS

The subject matter regarded as embodiments is particularly pointed out and distinctly claimed in the concluding portion of the specification. Embodiments, however, both as to organization and method of operation, may best be understood by reference to the following detailed description when read with the accompanying drawings in which:

DETAILED DESCRIPTION

Embodiments may be directed to apparatuses, systems and methods for pairing an article, such as a pair of eyeglasses, for example, with a security tag.

For example, one embodiment may include a security device comprising a locking mechanism, security tag, and a housing. The locking mechanism may comprise a magnetically actuable latch, a flexible element that biases the magnetically actuable latch toward a locking position, and a latch mating element that mates with at least a portion of the magnetically actuable latch in the locking position. As used herein, the "locking position" may refer to the position of the magnetically actuable latch in which it is partially or fully within a void of, in engagement with, joined with, or otherwise mated with the latch mating element. The housing may be a structure configured to partially or fully contain, enclose, or otherwise secure the locking mechanism, security tag, latch mating element, and the article to the housing. As secured, the magnetically actuable latch of the locking mechanism may mate with the latch mating element in the locking position to lock the housing, and thus the security tag with which the housing is secured, to the article. When the housing is locked, the security device may prevent or provide resistance to an attempt to separate the housing from the article. Another embodiment may include a security system comprising the security device and a detacher, which may be a device that includes a magnet. The detacher may be employed to unlock the housing by magnetically forcing the magnetically actuable latch away from the locking position.

It is worthy to note that any reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Numerous specific details may be set forth herein to provide a thorough understanding of the embodiments. It will be understood by those skilled in the art, however, that the embodiments may be practiced without these specific details. In other instances, well-known methods, procedures and components have not been described in detail so as not to obscure the embodiments. It can be appreciated that the specific structural and functional details disclosed herein may be representative and do not necessarily limit the scope of the embodiments.

Figure 1:
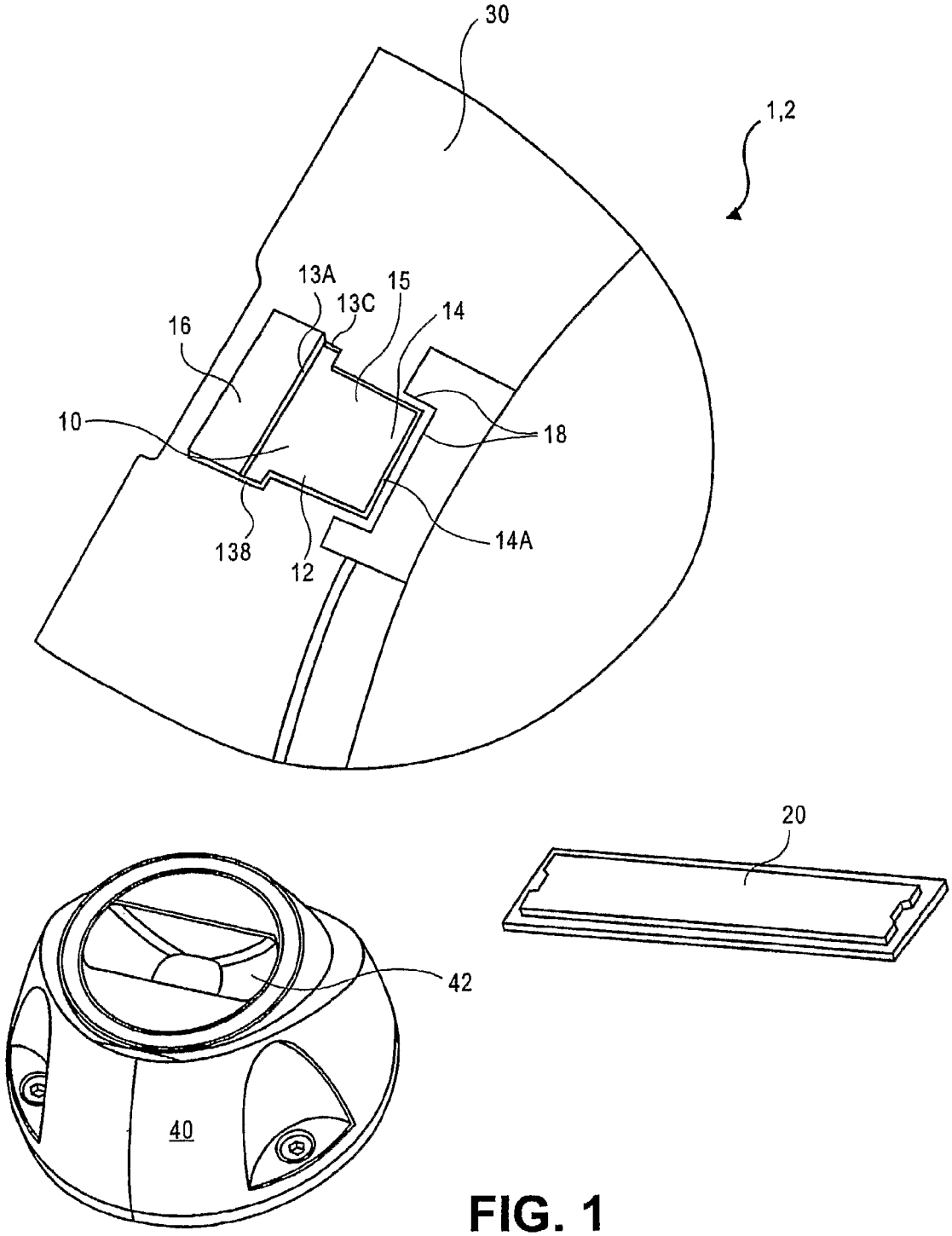
FIG. 1 illustrates components of a security device and system, in accordance with one embodiment.
Figure 1A:
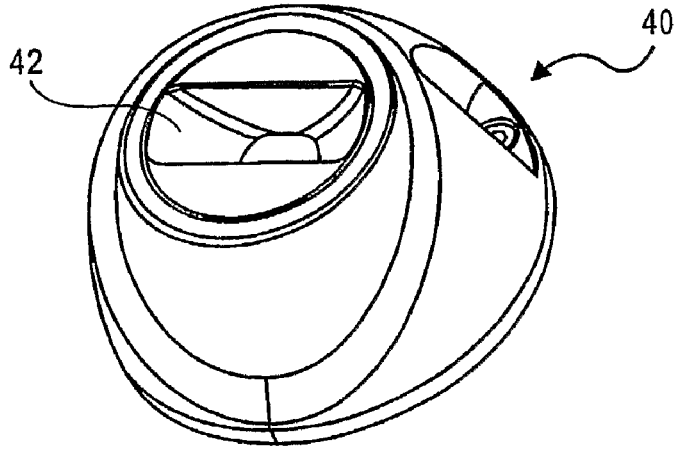
FIG. 1A illustrates a perspective view of a detacher, in accordance with one embodiment.
Figure 1B:
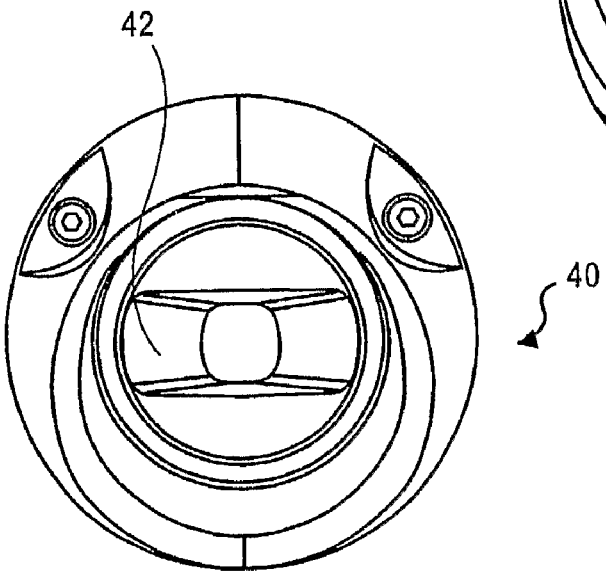
FIG. 1B illustrates a top view of a detacher, in accordance with one embodiment.
Figure 1C:
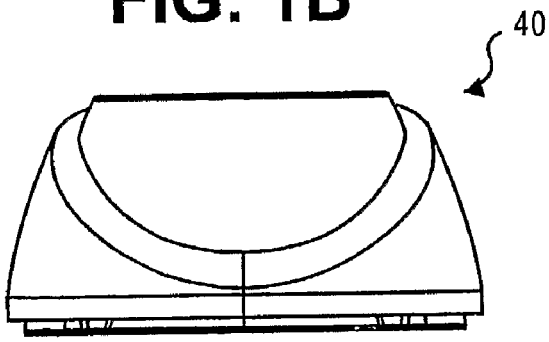
FIG. 1C illustrates a front view of a detacher, in accordance with one embodiment.
Figure 1D:
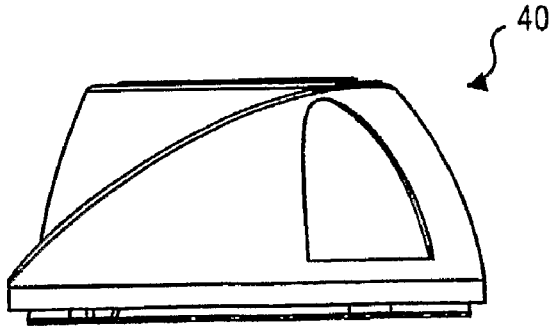
FIG. 1D illustrates a side view of a detacher, in accordance with one embodiment.

Referring now in detail to the drawings wherein like parts are designated by like reference numerals throughout, there is illustrated in FIG. 1 a front view of components that may be included in a security system 1 and a security device 2 in accordance with one embodiment. In this embodiment, the security system 1 includes the security device 2 and a detacher 40. The security device 2 may include a locking mechanism 10, security tag 20, and housing 30.

The locking mechanism 10 may be a magnetically actuable locking mechanism, and may include a magnetically actuable latch 12, flexible element 16, and latch mating element 18.

The magnetically actuable latch 12 may include a base portion 13, which may include a base portion end 13A and side surfaces 13B and 13C; and a latching portion 14, which may include a latching portion end 14A; and a central portion 15.

The magnetically actuable latch 12 may have a substantially rectangular-shaped face such that the base portion 13 has the same width as both the latching portion 14 and central portion 15. Thus, the width of the base portion 13, or the distance between the side surfaces 13B and 13C, may be the same as the corresponding widths of the latching portion 14 and central portion 15. In other embodiments, the widths of the base portion 13, latching portion 14, and central portion 15 may differ. The magnetically actuable latch 12 may have a slender, uniform cross-section.

However, the magnetically actuable latch 12 may be configured as desired, may comprise one or more pieces, and may be symmetrical or unsymmetrical about any point, line, or plane. For example, in various embodiments the magnetically actuable latch 12 may be configured with a "T", "I", curved, or other shape of face and with a rectangular, circular, thick, hollow or otherwise voided, and/or non-uniform cross-section, or as described herein with respect to embodiments of the magnetically actuable latches 312, 512, and 712. In another embodiment, the latching portion end 14A of the magnetically actuable latch 12 may include one or more teeth, ribs, notches, jags, points, curves, voids, or other shapes such as those described herein with respect to embodiments of the magnetically actuable latches 312, 512, and 712, while the base portion end 13A may be flat or another shape. In addition, the base portion end 13A may be continuous or discontinuous. The magnetically actuable latch 12 may be configured such that at least a portion of it, such as the latching portion 14, may engage, receive, insert into, or otherwise mate with the latch mating element 18, such as described herein.

In one embodiment, a security device 2 includes multiple magnetically actuable latches 12, which may be disposed, possibly each along with another flexible element 16 and latch mating element 18, in the same or different portions of the security device 2. For example, in one embodiment, the multiple magnetically actuable latches 12 may each cooperate with another portion of the security device 2 to lock the portion, such as, for example, a portion securing an article or a portion securing a security tag 20.

The magnetically actuable latch 12 may comprise or may be formed of a magnetic material such as iron, nickel, or cobalt, or an alloy of iron, nickel, or cobalt. In one embodiment, the magnetically actuable latch 12 includes one or more magnetic materials and may also include one or more non-magnetic materials.

The flexible element 16 may be shaped as desired, such as in a cuboid, ellipsoid, coil, or any other shape such as described herein, and may include one or more pieces, or may be combined or integrally formed with the magnetically actuable latch 12. In one embodiment, the flexible element 16 may be shaped as a cantilever arm, such as, for example, a leaf spring. The flexible element 16 may comprise or may be formed of a flexible material such as a light, porous, semi-rigid, elastic, gaseous, and/or spongy material that may provide a resistant force when compressed and may partially or fully recover its uncompressed shape when the compressive force is removed. For example, in various embodiments, the flexible element 16 may comprise or may be formed of a foam rubber, polymeric foam, ceramic foam, or other foam; a rubber; and/or another material or materials. The flexible element 16 may also or alternatively be configured to provide the resistant force when compressed. For example, in various embodiments the flexible element 16 may be configured as a coil, leaf or other cantilevered arm, or other spring, or other like member, that comprises a metal, polymer, ceramic, and/or another material or materials. The flexible element 16 may have any of various masses.

The latch mating element 18 may be configured as desired, such as with one or more holes or other voids, ribs, teeth, protrusions, or other shapes. The latch mating element 18 may include one or more pieces, and may be separate from or integral with the housing 30, such as described herein. The latch mating element 18 may be configured to engage, receive, insert into, or otherwise mate with at least a portion of the magnetically actuable latch 12. For example, in an embodiment where the magnetically actuable latch 12 is a slender member with a rectangular shape of face, the latch mating element 18 may be configured with a void in which the latching portion 14 of the magnetically actuable latch 12 or a part thereof may be inserted into the locking position, as described herein. In an embodiment where the magnetically actuable latch 12 is toothed at its latching portion end 14A, the latch mating element 18 may be configured with ribs that engage the teeth in the locking position.

The security tag 20 may be any detectable device or system, such as any security tag or label. For example, in various embodiments the security tag 20 may be any type of EAS tag (e.g., Radio Frequency (RF) tag, acousto-magnetic tag, and/or combinations thereof), Radio Frequency Identification (RFID) tag, smart tag, or other detectable anti-theft or other tag. The security tag 20 may be detectable by a corresponding detecting system or device, such as, depending on the type of security tag or label, an acousto-magnetic detector, electromagnetic detector, radio frequency detector, or other detector.

The housing 30, as partially shown in the embodiment of FIG. 1, may be any casing or other structure that partially or fully contains and/or surrounds, encloses, affixes to, interlocks with, or otherwise secures the locking mechanism 10 and security tag 20, and, when the locking mechanism 10 is in the locking position and the housing is thereby locked, an article. The housing 30 and locking mechanism 10 may thus cooperate to secure, or lock, the article to the housing 30, and thus the security device 2. The housing 30 may be configured as desired, and may be shaped based upon the shapes of the locking mechanism 10, security tag 20, and article for which it is designed to secure, such as described herein with respect to the embodiments of the housings 330, 530, and 730. The housing 30 may include the latch mating element 18, which may be integral with the housing 30. The housing 30 may alternatively be configured to pair with the latch mating element 18. The housing 30 may comprise a polymer and/or another material or materials.

The components included in the security device 2 may be configured such that the security device 2 may lock to an article, such as described with respect to the security device embodiments below. The security tag 2 may be reusable or may be for one-time use.

FIGS. 1A-1D illustrate a perspective, top, front, and side view of the detacher 40 shown in FIG. 1, in accordance with one embodiment. The detacher 40 may be a device that includes and houses a magnet 42. The magnet 42 may be any type of magnet, such as any permanent magnet or electromagnet, for example. Regarding the security system 1, the detacher 40 may be employed with the security device 2 to unlock the security device 2 from an article. The detacher 40 may be positioned appropriately near the magnetically actuable latch 12 of the security device 2 to magnetically force the magnetically actuable latch 12 away from the locking position, thus allowing the housing 30 of the security device 2 to be removed from an article to which it may be locked.

In various embodiments, the detacher 40 may include different magnets 42. For example, the magnet 42 of the detacher 40 may be selected based upon the magnetic force needed to move the magnetically actuable latch 12 away from the locking position, thus unlocking the security device 2. This magnetic force may need to more than offset the forces opposing the movement. Such opposing forces may include, for example, the resistant force provided by the flexible element 16 when it is compressed by the magnetically actuable latch 12, frictional forces caused by the magnetically actuable latch 12 contacting the housing 30 and/or another element during movement, and other forces. In another embodiment, where a detacher 40 is intended to be used on various security devices having different configurations, a magnet 42 may be selected that is strong enough to unlock the security device requiring the strongest magnet to unlock it.

Figure 1E:
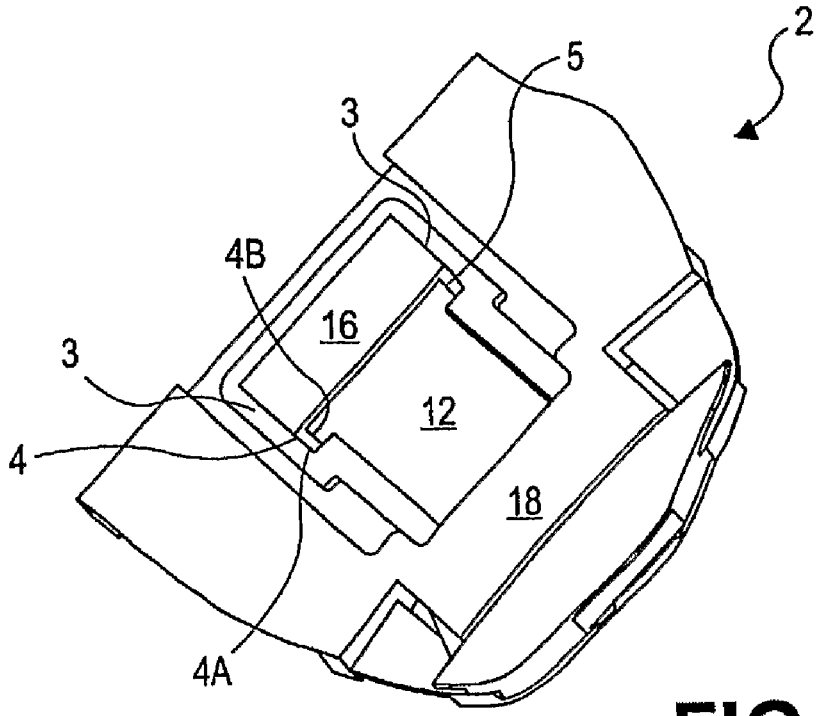
FIG. 1E illustrates a perspective view of a portion of a security device configured for one-time use.
Figure 1F:
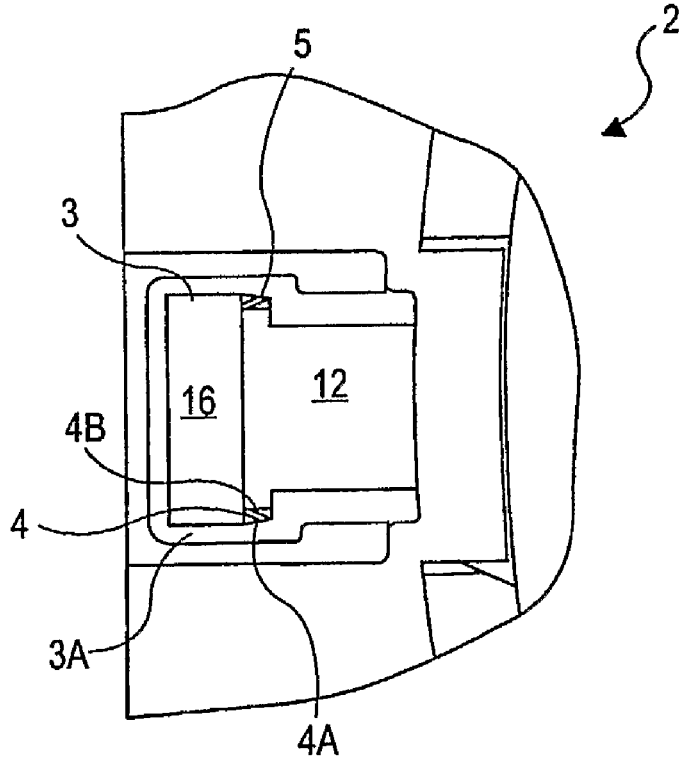
FIG. 1F illustrates a top view of portion of a security device configured for one-time use.
Figure 1G:
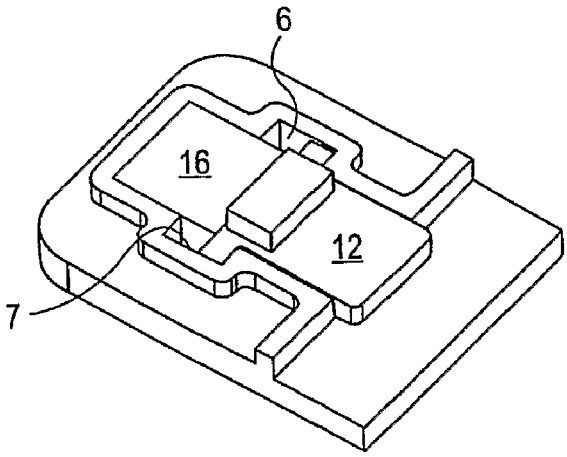
FIG. 1G illustrates a perspective view of a portion of a security device configured to be resettable.
Figure 1H:
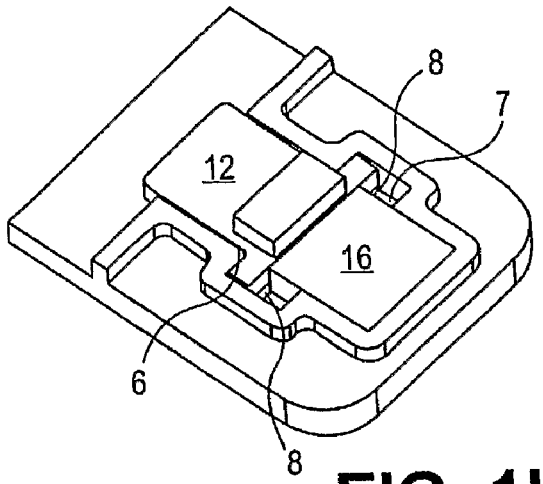
FIG. 1H illustrates a perspective view of a portion of a security device configured for one-time use.
Figure 1I:
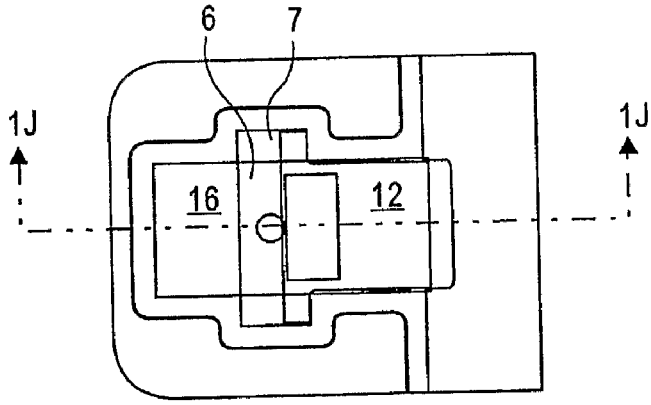
FIG. 1I illustrates a top view of a portion of a security device configured for one-time use.
Figure 1J:
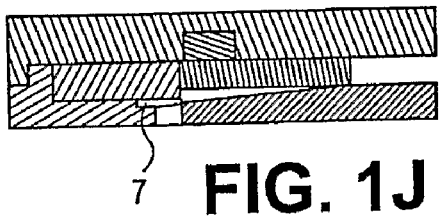
FIG. 1J illustrates a front view of a portion of a security device configured for one-time use.
Figure 2:
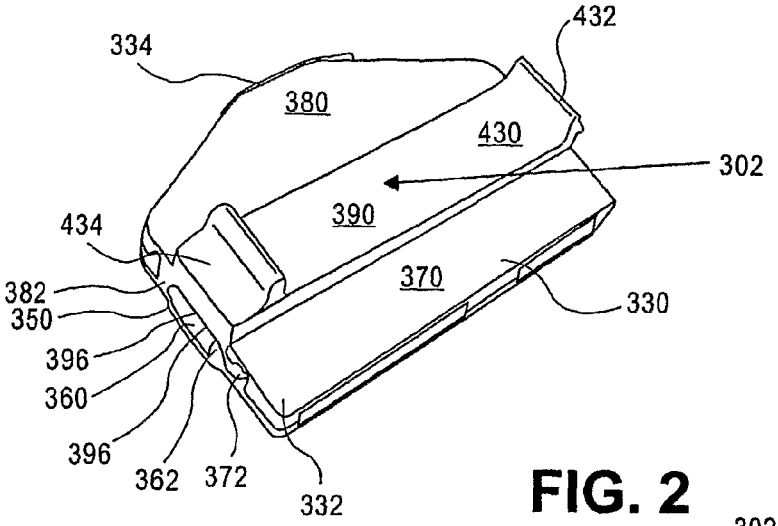
FIG. 2 illustrates a perspective view of a CEM security device, in accordance with one embodiment.
Figure 3:
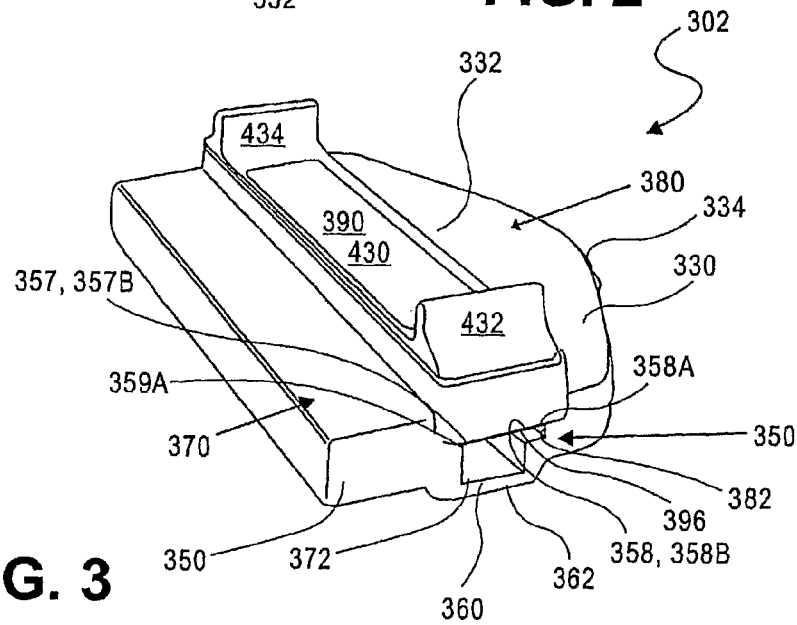
FIG. 3 illustrates a perspective view of a CEM security device, in accordance with one embodiment.
Figure 4:
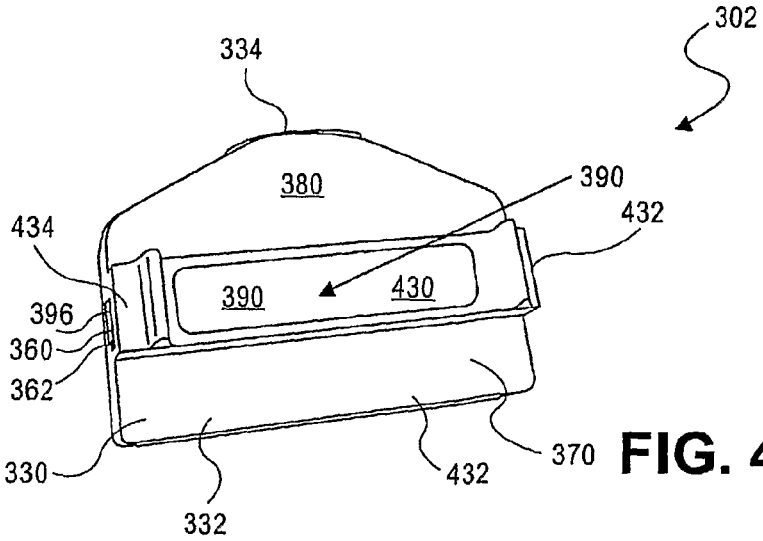
FIG. 4 illustrates a perspective view of a CEM security device, in accordance with one embodiment.
Figure 5:
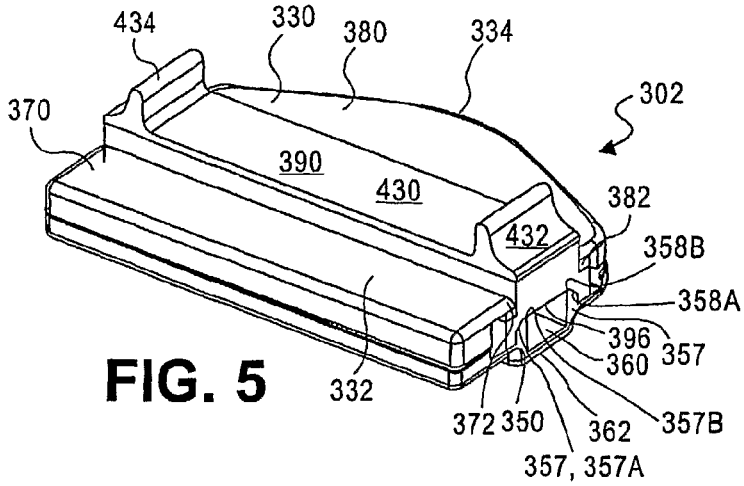
FIG. 5 illustrates a perspective view of a CEM security device, in accordance with one embodiment.

In one embodiment, the security device 2 may be configured for one-time use. For example, in one embodiment as shown in FIGS. 1E-1F, the magnetically actuable latch 12 of the security device 2 may be positioned within a channel 3 as mated with the latch mating element 18 in the locking position. One or more leaf springs or other cantilevered arms, such as the cantilevered arms 4 and 5, are disposed in the channel 3 in a spring-loaded configuration.

For example, the cantilevered arm 4 may have an unloaded position as shown in FIG. 1E. The cantilevered arm 4 may be bent to a position with its side 4A adjacent the channel wall 3A, and thus spring-loaded. The magnetically actuable latch 12 may then be disposed in the channel 3 in the locking position adjacent its other side 4B, preventing the cantilevered arm 4 from moving and preserving its spring load. The cantilevered arm 5 may be similarly positioned. Where the magnetically actuable latch 12 is then moved out of the locking position by the detacher 40, the cantilevered arms 4 and 5 may no longer be constrained by the magnetically actuable latch 12 and may spring back or otherwise return to their unloaded positions. Where in these positions the cantilevered arms 4 and 5 extend into the channel 3 such that they may block the base portion 13 of the magnetically actuable latch 12 from moving past them, the magnetically actuable latch 12 may not be able to return to the locking position. Thus, any appended security device may no longer be able to lock.

In another embodiment, only one of the cantilevered arms 4 and 5 is included. In various other embodiments, other resilient elements, such as coils or other springs, rubbers, and foams, for example, may be employed within the channel 3 or other portion of the housing to prevent the appended security device from being used twice.

In another embodiment such as shown in FIGS. 1G-1J, the locking mechanism portion and housing portion may be configured such that after each instance the magnetically actuable latch 12 is moved out of the locking position, the magnetically actuable latch 12 may need to be reset to enable it to be repositioned in the locking position. For example, the magnetically actuable latch 12 may be disposed in a channel 6 with its base end 13A adjacent a recess 7. The recess 7 may be configured such that where the magnetically actuable latch 12 is biased out of the locking position, at least a portion of the magnetically actuable latch 12 falls or is otherwise urged into the recess 7. The recess may be delineated by a wall 8 that may restrict movement of the magnetically actuable latch 12 back toward the locking position. In this embodiment, the security device in which the magnetically actuable latch 12 is disposed may be "reset" for use, such as by employing a magnet that may move the magnetically actuable latch 12 out of the recess.

In another embodiment, a constrained elongate member (CEM) security device 302, such as described with respect to the embodiments of FIGS. 2-16, may include a locking mechanism 310, a security tag, and a housing 330. As used herein, a "constrained elongate member," or "CEM," is a structure comprising an elongate element that, when extended through a tunnel of a security device such as described herein, is constrained from being removed from the tunnel. A "tunnel" may be any hole, conduit, aperture or other void that extends completely through a structure, and which may, in certain embodiments, be elongate in form. The constrained elongate member may be constrained by portions of the article that extend from either end of the constrained elongate member, and which are sized, shaped, angled, or otherwise configured such that they may block or otherwise prevent or provide resistance to the attempted removal of the constrained elongate member from the tunnel.

For example, one article having a constrained elongate member may be a pair of eyeglasses, whose constrained elongate member may be a proximal portion of one of its legs. An eyeglasses leg may be a portion of a pair of eyeglasses that includes proximal and distal leg portions. The proximal leg portion may extend from the eyeglasses frame to the distal leg portion, which may further extend angularly, such as by curve, from the proximal leg portion and may be configured to fit adjacent a wearer's ear. Where the proximal leg portion extends through the tunnel, the distal leg portion, by its angle relative to the proximal leg portion, may prevent or provide resistance to an attempt to pull the distal leg portion through the tunnel and thereby remove the eyeglasses from the tunnel of the security device.

In another example, an elongate member that is without ends (e.g., endless), such as any of certain necklaces and chains, may be a constrained elongate member since it does not have an end to slide or pull, for example, out of the tunnel.

The constrained elongate member security device may surround the constrained elongate member within its tunnel and thereby lock the security device to the tunnel.

FIGS. 2-5 illustrate various perspectives views of a CEM security device 302, in accordance with one embodiment, and may be referred to where a corresponding element thereof is discussed. The CEM security device 302 in this embodiment includes a housing 330 that may include various portions, such as a bottom housing 350, top housing 370, locking mechanism cover 380, and handle assembly 390, such as described below. Each portion may comprise one or more materials, such as plastics and metals, and the portions may comprise the same or different materials, or a combination thereof.

Figure 7:
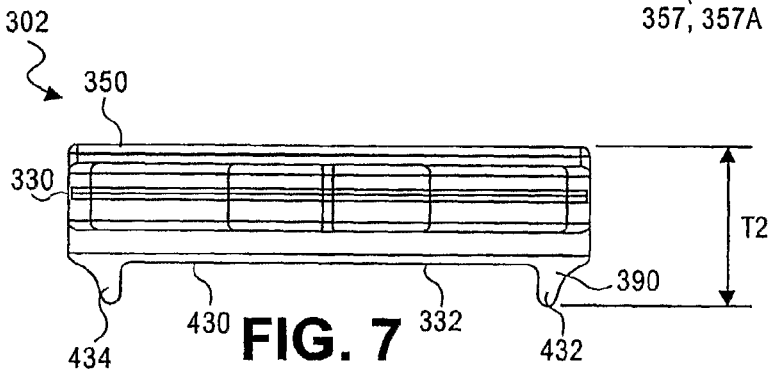
FIG. 7 illustrates a front view of a CEM security device, in accordance with one embodiment.
Figure 6:
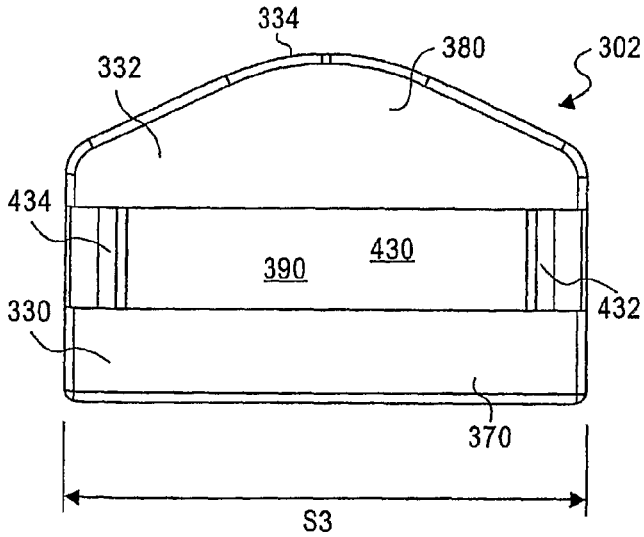
FIG. 6 illustrates a top view of a CEM security device, in accordance with one embodiment.
Figure 8:
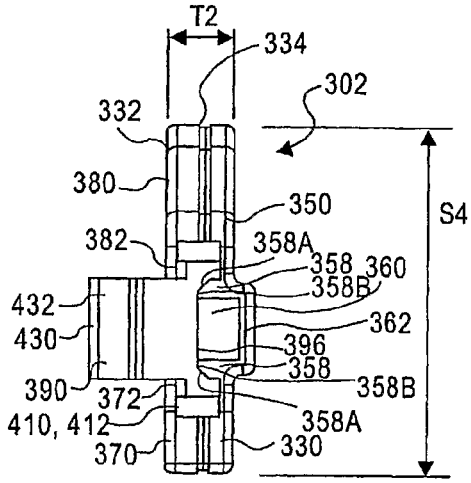
FIG. 8 illustrates a side view of a CEM security device, in accordance with one embodiment.

FIGS. 6-8 illustrate a top view, front view, and side view, respectively, of a CEM security device 302, in accordance with one embodiment. As shown in this embodiment, the housing 330, and thus the CEM security device 302, may have a top outer face 332 that is at least partially rectangular but with an outwardly bowed side 334, as viewed from the top view of FIG. 2. The top outer face 332 may include one or more protruding portions, the handles 432 and 434, which are described below. The housing 330 may have a slender thickness, which may be greatest in the vicinity of the handles 432 and 434. In one embodiment, the housing 330 has outer dimensions such that the top outer face 332 has the approximate side dimensions S3 and S4 of 42 mm and 28.36 mm, respectively, and the housing 330 may have approximate thicknesses T1 and T2 of 13.14 mm and 5.36 mm, respectively. However, in various embodiments, the housing 330, and components thereof, may be sized and dimensioned as desired, such as described with respect to the housing 30 of the FIG. 1 embodiment, for example. The housing 330 may be configured, such as described herein, to secure the security tag and a leg of a pair of eyeglasses or other CEM, and thus may lock the CEM security device 302 to the CEM, such as described below.

Figure 9:
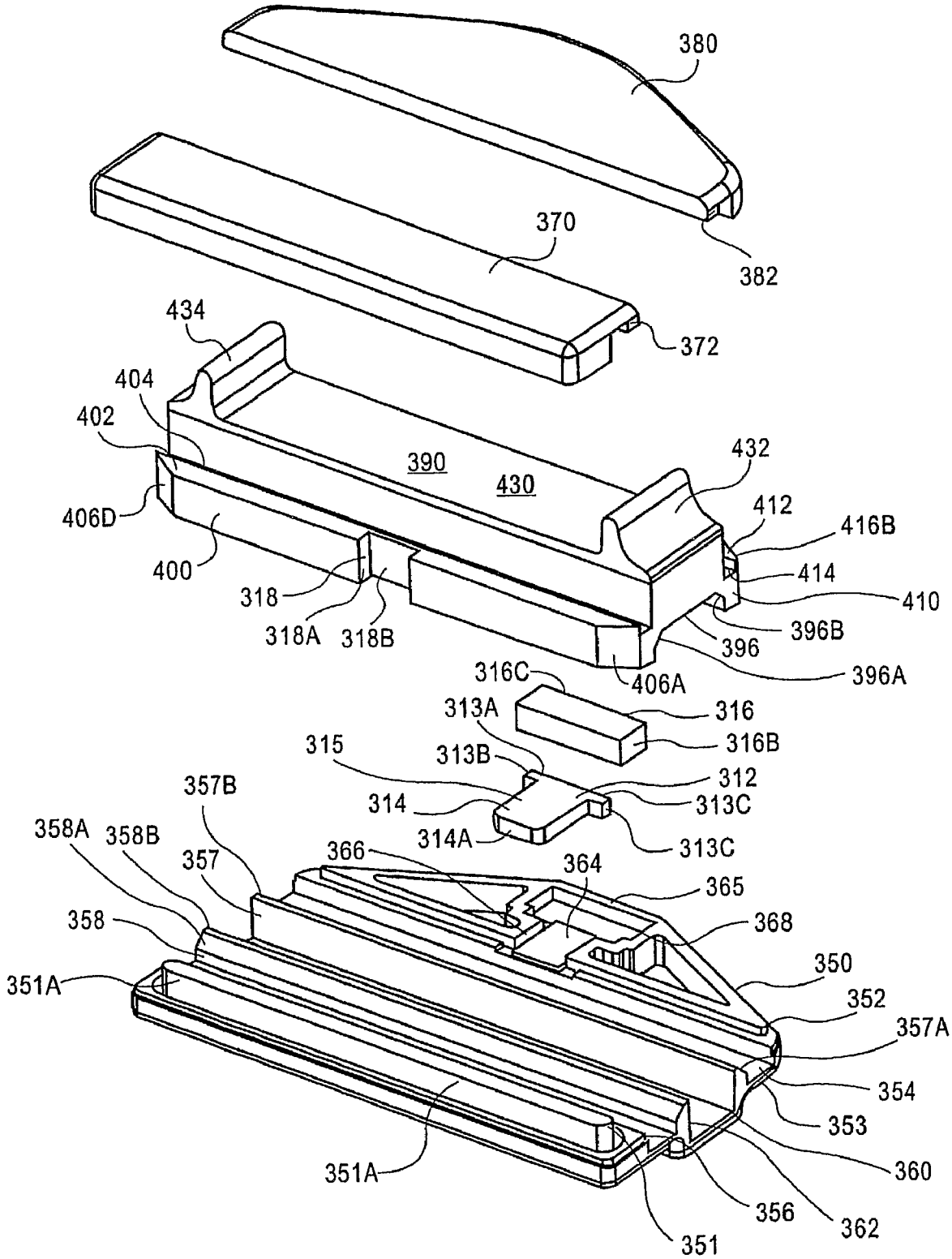
FIG. 9 illustrates an exploded view of a CEM security device, in accordance with one embodiment.
Figure 10:
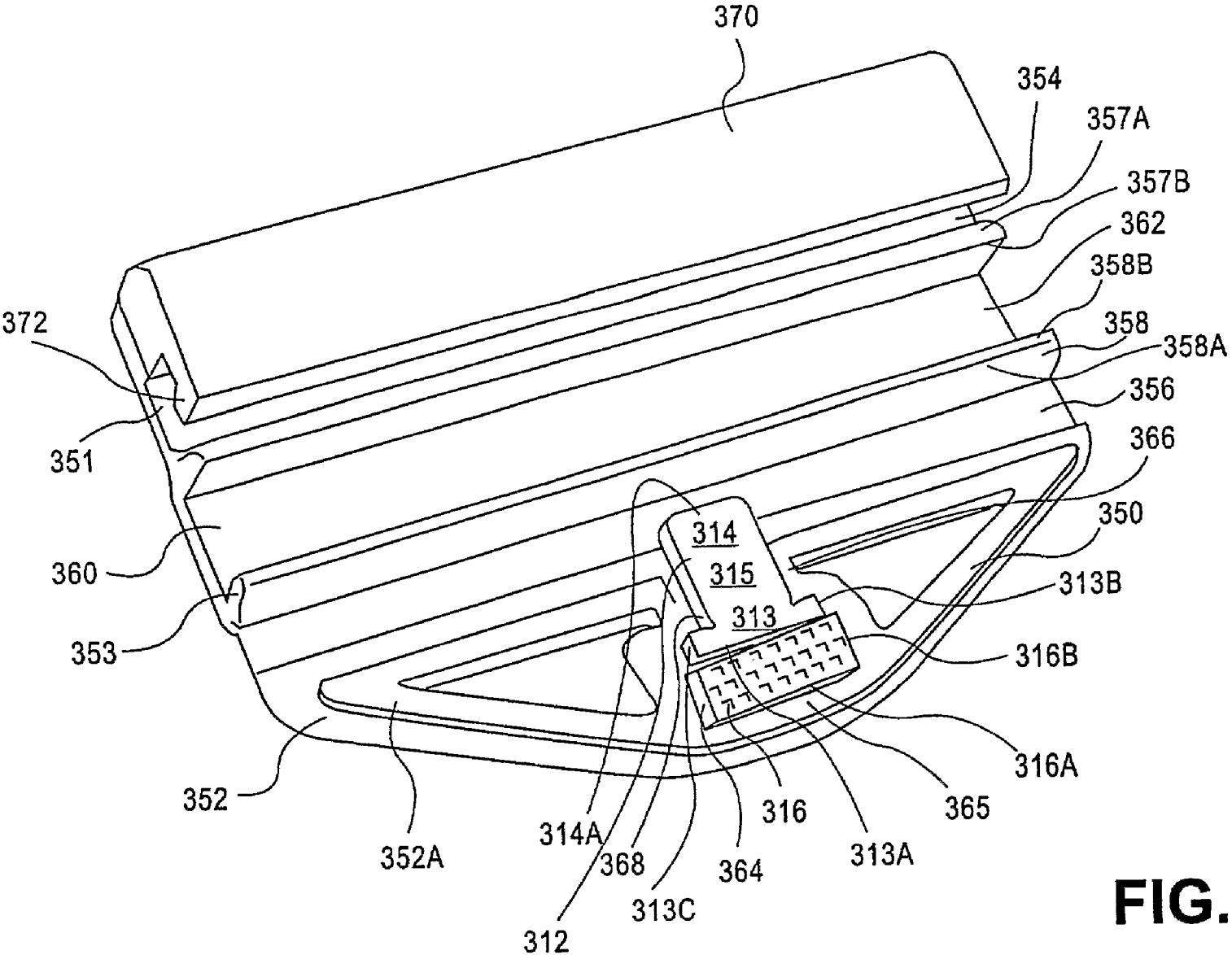
FIG. 10 illustrates a perspective view of a locking mechanism portion, bottom housing, and top housing of a CEM security device, in accordance with one embodiment.

FIG. 9 illustrates an exploded view of a CEM security device 302, showing elements that may be included therewith, in accordance with one embodiment. This figure may be referred to where a corresponding element thereof is discussed.

Figure 11:
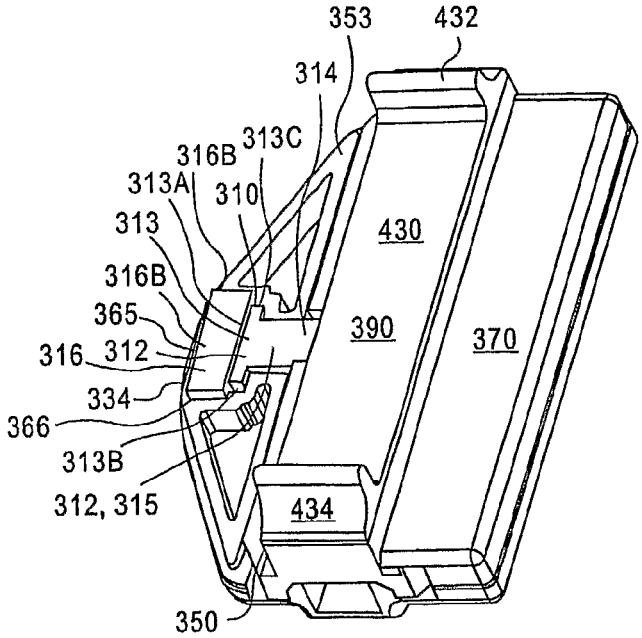
FIG. 11 illustrates a perspective view of a locking mechanism, top housing, bottom housing, and handle assembly of a CEM security device, in accordance with one embodiment.
Figure 12:
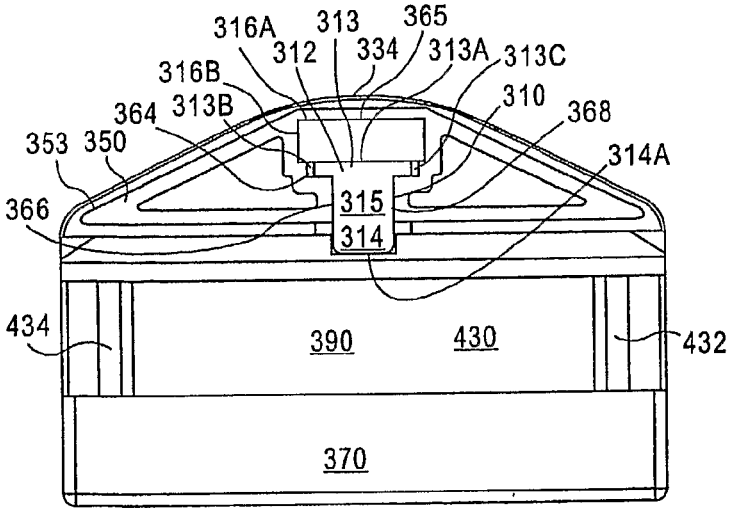
FIG. 12 illustrates a top view of a locking mechanism, top housing, bottom housing, and handle assembly of a CEM security device, in accordance with one embodiment.
Figure 13:
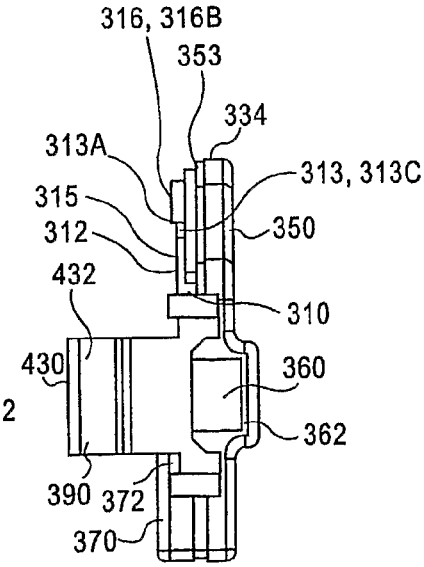
FIG. 13 illustrates a side view of a locking mechanism, top housing, bottom housing, and handle assembly of a CEM security device, in accordance with one embodiment.

FIGS. 10-13 illustrate a perspective, perspective, top, and side view, respectively, of a locking mechanism 310 or portion thereof, bottom housing 350, and top housing 370 of a CEM security device 302, in accordance with one embodiment. FIGS. 11-13 also show a handle assembly 390, in accordance with one embodiment.

Referring to FIGS. 10-13, the locking mechanism 310 may include a magnetically actuable latch 312 or portion thereof, a flexible element 316, and a latch mating element 318. The magnetically actuable latch 312 may comprise a magnetic material, and may comprise one or more materials such as described with respect to the magnetically actuable latch 12 of FIG. 1. The magnetically actuable latch 312 may include a base portion 313, which may include a base portion end 313A and base portion side surfaces 313B and 313C; a latching portion 314, which may include a latching portion end 314A; and a central portion 315.

The magnetically actuable latch 312 may be shaped like a "T". Thus, the base portion side surfaces 313B and 313C may be parallel and each may be at least substantially straight, and the width of the base portion 313, which may be the distance between base portion side surfaces 313B and 313C, may be wider than the other widths of the magnetically actuable latch 312. The base portion end 313A may be flat and may be substantially perpendicular to the base portion side surfaces 313B and 313C. The magnetically actuable latch 312 may be configured with a slender-thickness. However, the magnetically actuable latch 312 may be otherwise configured in various embodiments, such as described herein with respect to the magnetically actuable latch 12 shown in FIG. 1.

The flexible element 316 may comprise or be formed of a flexible material, and may include a material or materials such as described herein with respect to the flexible element 16 shown in FIG. 1. The flexible element 316, in one embodiment, may be configured with a substantially cuboidal shape such that its side 316A is wider than its side 316B, or may have another shape. In various other embodiments, the flexible element 316 may be configured as, and comprise one or more materials of, a coil or other spring or like member, such as described above with respect to the magnetically actuable latch 12 of FIG. 1.

The latch mating element 318 may be integral with the housing 330 or a portion thereof and may comprise a recess in the handle assembly 390, such as described below, or may be a separate piece or pieces.

The bottom housing 350 of the housing 330 may be configured such that the magnetically actuable latch 312 and flexible element 316 of the locking mechanism 310 may be adjacently disposed therein. Thus, the base portion end 313A of the magnetically actuable latch 312 may be positioned near or in abutment with the flexible element 316. With such a configuration, the movement of the magnetically actuable latch 312 and flexible element 316 may be restricted in one or more directions.

For example, the bottom housing 350 may include a channel end wall 365, channel walls 366 and 368, and a channel 364 delineated by channel walls 366 and 368 and bounded by the channel end wall 365. The channel walls 366 and 368 may include portions substantially parallel to each other, and may be positioned close to or in contact with the magnetically actuable latch 312 at the base portion side surfaces 313B and 313C and at the sides of the central and latching portions 315 and 314, respectively, thereby restricting the movement of the magnetically actuable latch 312 to movement along the channel 364, which may be movement in a substantially linear direction.

In various other embodiments, the magnetically actuable latch 312 may move in a rotational, combination rotational/linear direction, or any other direction or directions. In these various other embodiments, one or more of the channel 364, flexible element 316, and latch mating element 318 may be contoured, shaped, or otherwise configured to guide the magnetically actuable latch 312 in the direction or directions. The magnetically actuable latches 512 and 712 described below may also, in various embodiments, move in such a direction or directions.

The flexible element 316 may be positioned adjacent the channel end wall 365 such that where the magnetically actuable latch 312 is forced away from the locking position and against the flexible element 316, the flexible element 316 may compress by the force of the magnetically actuable latch 312 and the resistant force of the channel end wall 365. The flexible element 316 may provide a resistant force to such compression, against such movement of the magnetically actuable latch 312.

As described above, in each of various embodiments the magnetically actuable latch 312 may be configured with another shape, in which case the channel 364, and thus the channel walls 366 and 368, may be configured to accommodate such a magnetically actuable latch 312 and possibly restrict the movement of the magnetically actuable latch 312 in one or more directions. In each of these embodiments, the flexible element 316 may be configured to fit within the channel 364.

The bottom housing 350 of the housing 330 may be further or alternatively configured to receive a top housing 370, locking mechanism cover 380, handle assembly 390, and a CEM. In one embodiment, the bottom housing 350 may include a top housing receiving portion 351, locking mechanism cover receiving portion 352, handle assembly receiving portion 353, and a CEM tunnel wall 362.

The top housing receiving portion 351 may include a top housing receiving wall 351A that may receive a similarly-shaped recess of the top housing 370. The top housing receiving portion 351 may be alternatively configured based upon configuration of the top housing 370, or otherwise configured to receive the top housing 370.

The locking mechanism cover receiving portion 352 may include a locking mechanism cover receiving wall 352A that may receive a similarly-shaped recess of the locking mechanism cover 380. The locking mechanism cover receiving portion 352 may be alternatively configured based upon the configuration of the locking mechanism cover 380, or otherwise configured to receive the locking mechanism cover 380.

The handle assembly receiving portion 353 may comprise pathways 354 and 356 through which runners 400 and 410 of the handle assembly 390 may respectively extend, such as described below. The pathways 354 and 356 may comprise voids delineated by pathway walls 357 and 358, respectively. The pathway walls 357 and 358 may be at least partially "U" shaped, and may further comprise chamfers 357A and 358A and top walls 357B and 358B, respectively.

The CEM tunnel wall 362 may be "U" shaped or otherwise configured to receive a proximal portion of an eyeglasses leg or another CEM. Where the CEM tunnel hood 396 of the handle assembly 390 is positioned adjacent the CEM tunnel wall 362 and over the CEM, as explained below, the CEM tunnel 360 may thereby be delineated. The CEM may thus be surrounded and may thus be blocked from removal, and thus secured to the CEM security device 302, unless the CEM tunnel hood 396 is removed.

The top housing 370 may be configured with a shape that is at least partially rectangular and/or a shape which may be similar to that of a portion of the housing 330. The top housing 370 may include a flange 372, which may "L" shaped and may be to couple the top housing 370 with the handle assembly 390, such as explained below. The top housing 370 may have a slender thickness. However, in various embodiments, the top housing 370 may be otherwise or additionally configured, such as to receive the coupling wall 351A of the bottom housing 350 during connection. The top housing 370 may also or alternatively be secured to the bottom housing 350 by welding, fusing, gluing, snap-fit (such as where the bottom housing 350 and top housing 370 are configured with mating protrusions and voids, for example), interference fit, and/or by other securing means.

Referring back to FIG. 9, the locking mechanism cover 380 may be configured with a shape that is at least partially rectangular but with an outwardly bowed side 334 and may comprise the similarly-shaped portion of the outer face 332 of the housing 330, such as described herein with respect to the embodiment of FIG. 6. The locking mechanism cover 380 may include a flange 382, which may be "L" shaped and may be to couple with the handle assembly 390, as explained below. The flange 382 may have a shape similar to the flange 372 of the top housing 370.

The locking mechanism cover 380 may have a slender thickness. However, in various embodiments, the locking mechanism cover 380 may be otherwise configured to be secured to the bottom housing 350 and over the magnetically actuable latch 312 and flexible element 316 of the locking mechanism 310. The locking mechanism cover 380 may be secured to the bottom housing 350 by welding, fusing, gluing, snap-fit (such as where the bottom housing 350 and locking mechanism cover 380 are configured with mating protrusions and voids, for example), interference fit, and/or by other securing means. The locking mechanism cover 380 is also illustrated in the embodiments of FIGS. 2-5, for example, which may also be referred to with respect to this description.

Figure 14:
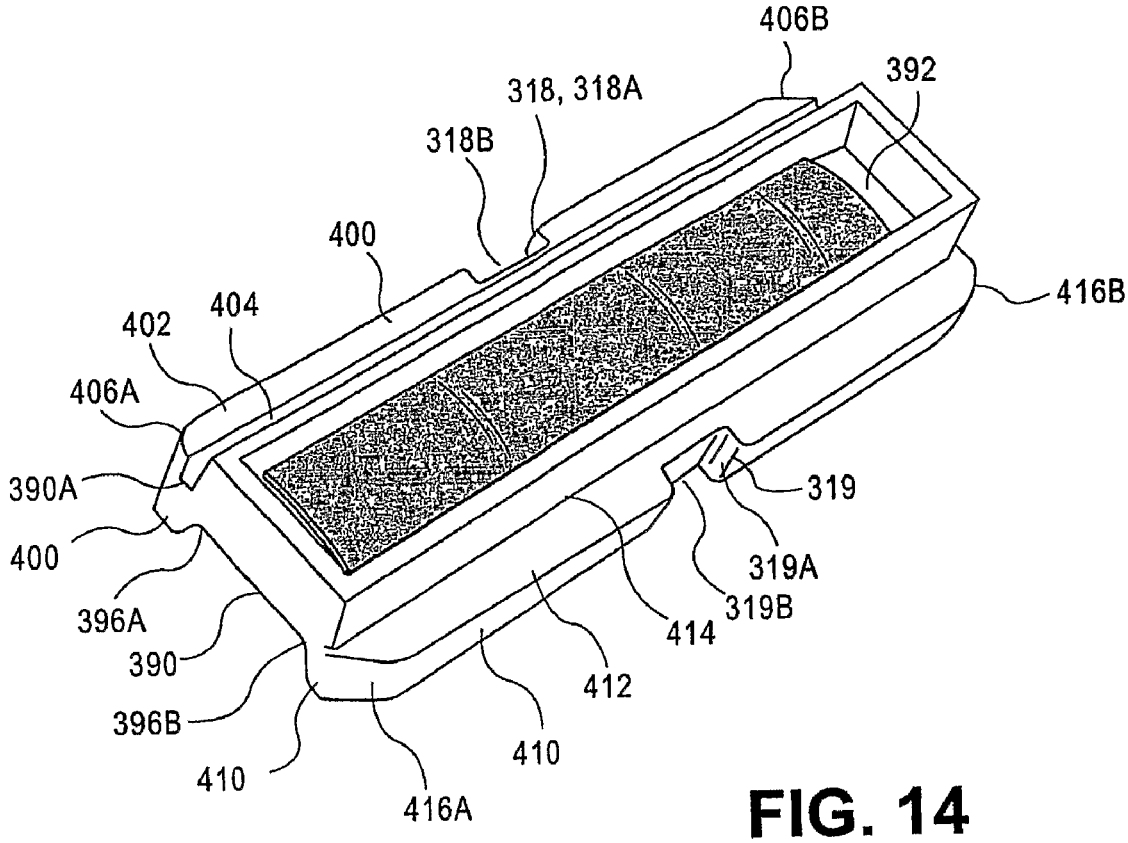
FIG. 14 illustrates a perspective view of lower assembly of a handle assembly of a CEM security device, in accordance with one embodiment.
Figure 15:
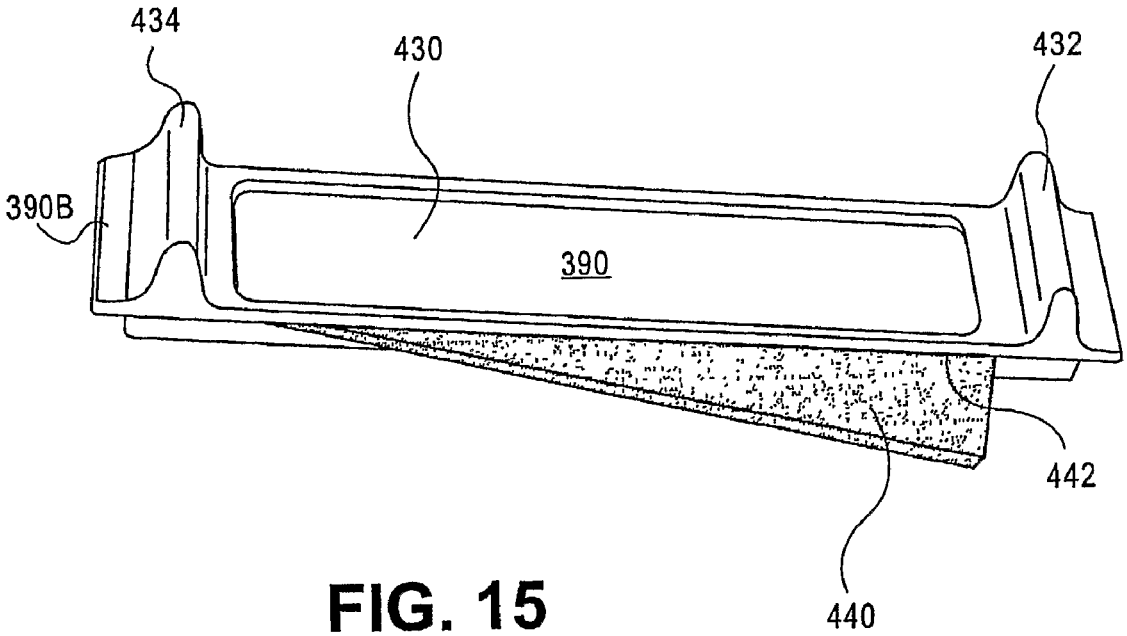
FIG. 15 illustrates a perspective view of an upper assembly of a handle assembly of a CEM security device, in accordance with one embodiment.

FIGS. 14-15 illustrate embodiments of a lower assembly 390A and an upper assembly 390B, respectively, of the handle assembly 390 such as shown, for example, in FIGS. 10-13. The handle assembly 390 in this embodiment may enclose or otherwise secure a security tag thereto.

Referring to FIG. 14, the lower assembly 390A may be an elongated member that is hollowed or otherwise includes a cavity 392, which may be sized or otherwise configured to contain a security tag or portion thereof. For example, in one embodiment the cavity 392 contains one or more linear amorphous resonators 394. In one embodiment the cavity may contain three linear amorphous resonators 394.

The lower assembly 390A may include a recessed underside delineated by a CEM tunnel hood 396. The CEM tunnel hood 396 may be configured to fit adjacent the CEM tunnel wall 362 of the bottom housing 350 to thereby, along with the CEM tunnel wall 362, delineate the CEM tunnel 360. The CEM tunnel hood 396 may be configured in a "U" shape but with chamfer mating surfaces 396A and 396B. With this configuration, the handle assembly 390 may be disposed on the bottom housing 350 such that the CEM tunnel hood 396 may be adjacent the top walls 357B and 358B, with the chamfer mating surfaces 396A and 396B adjacent the chamfers 357A and 358A. However, in various other embodiments, the CEM tunnel hood 396 and bottom housing 350 may be configured with a different mating arrangement.

Figure 17:
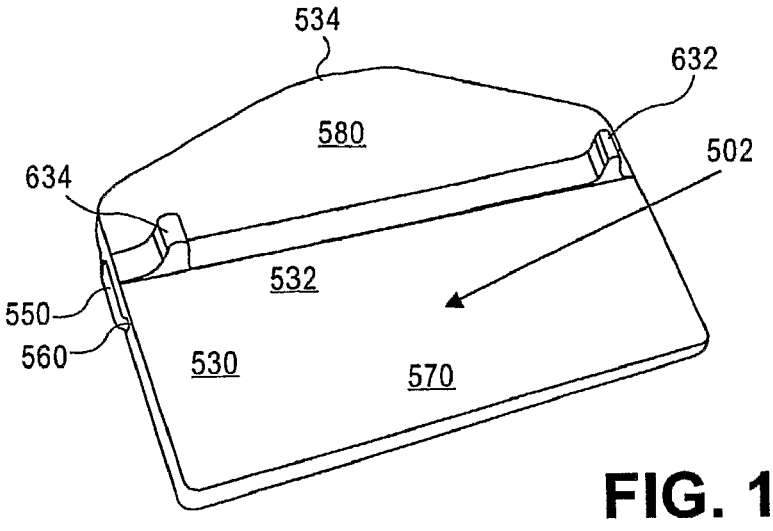
FIG. 17 illustrates a perspective view of a CEM security device, in accordance with one embodiment.
Figure 18:
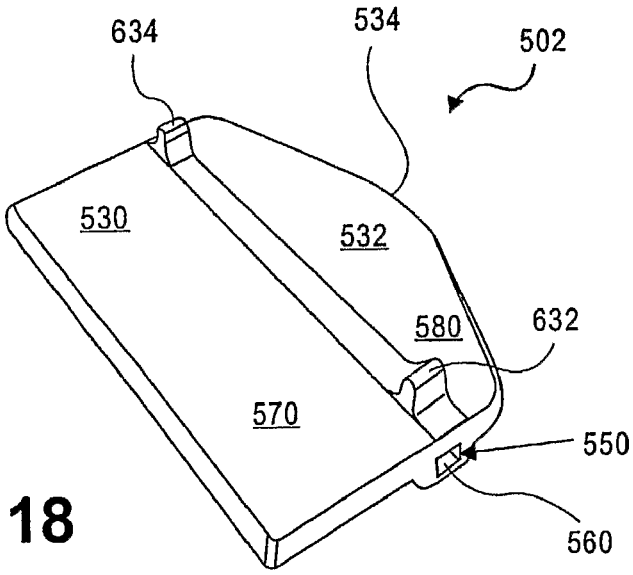
FIG. 18 illustrates a perspective view of a CEM security device, in accordance with one embodiment.
Figure 19:
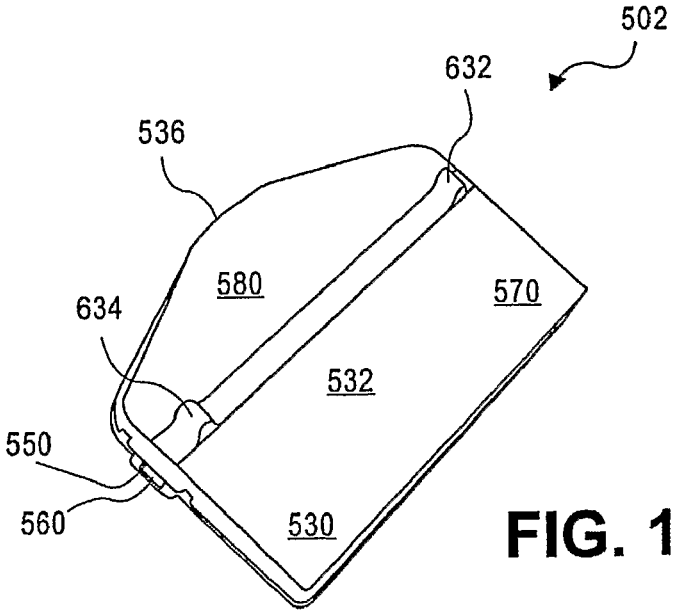
FIG. 19 illustrates a perspective view of a CEM security device, in accordance with one embodiment.
Figure 20:
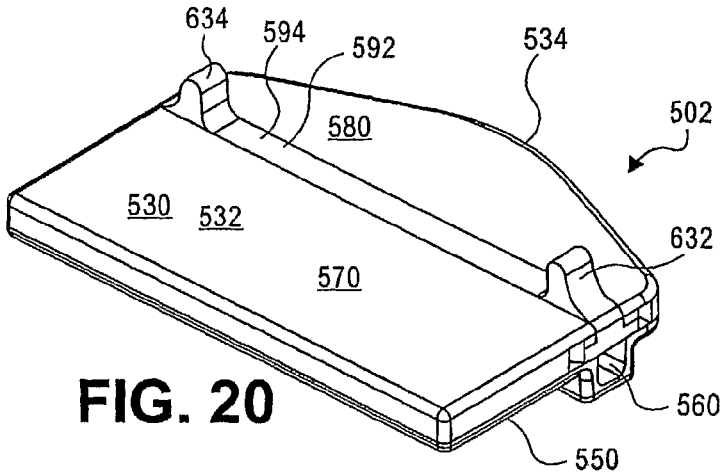
FIG. 20 illustrates a perspective view of a CEM security device, in accordance with one embodiment.

The lower assembly 390A may include runners 400 and 410, which may include top walls 402 and 412 and adjacent coupling indents 404 and 414, respectively. With such a configuration, where the CEM security device 302 is assembled, the top housing 370 and locking mechanism cover 380 may be coupled with a runner 400 or 410. The flange 372 of the top housing 370 may extend over the top wall 412 and into the coupling indent 414 of the runner 410, and the flange 382 of the locking mechanism cover 380 may extend over the top wall 402 and into the coupling indent 404 of the runner 400, such as shown, for example, in the embodiments of FIGS. 2-5 and 8. In various other embodiments, the top housing 370, locking mechanism cover 380, and the handle assembly 390 may be configured with different mating structures, such as with straight, overlapping walls, as described below with respect to the CEM security device 502 as shown in FIG. 17, for example. With such a configuration as assembled, the top housing 370 and locking mechanism cover 380 may prevent or provide resistance to movement of the handle assembly 390 relative to the housing 330 in a direction other than along the pathways walls 354 and 356 of the bottom housing 350.

In other embodiments, the handle assembly 390 may be variously coupled with the bottom housing 350. For example, in one embodiment, the handle assembly 390 may be hingedly coupled with the bottom housing 350 at one of elongated side of the handle assembly 390. The other side may include a pocket or slot extending therein such that when the handle assembly 390 is disposed on the bottom housing 350, the pocket or slot may be aligned to receive the magnetically actuable latch 312 in the locking position. As received, the magnetically actuable latch 312 may prevent or provide resistance to rotating the handle assembly away from the housing. If the magnetically actuable latch 312 is moved out of the locking position and thus out of the pocket or slot of the handle assembly 390, the handle assembly may be rotated about its hinge to expose the CEM tunnel 360, thus allowing any CEM disposed therein to be removed.

In one embodiment, the handle assembly 390 may be configured along with the bottom housing 350 or otherwise to the security device 302 to be coupled to the security device 302 by a combination of sliding and hinging. For example, in one embodiment, the handle assembly 390 may be slid partway along the bottom housing 350 until it abuts a structure with which it will cooperate to form a hinge. The handle assembly 390 may then be rotated about the hinge to expose the CEM tunnel 360 and thus any CEM disposed therein.

The runners 400 and 410 may include latch mating elements 318 and 319, respectively, which may be similarly configured. The latch mating element 318 may comprise a latch mating element wall 318A and a recess 318B or other void defined by the latch mating element wall 318A. The latch mating element 319 may have a similar configuration as part of the runner 410, with a latch mating element wall 319A and recess 319B.

The latch mating elements 318 and 319 may be positioned such that where the CEM security device 302 is assembled, one of the latch mating elements 318 and 319 is aligned with the magnetically actuable latch 312 of the locking mechanism 310. In one embodiment, the CEM security device 302 is symmetrical such that it may be disposed on the bottom housing 350, as described herein, with either latch mating element 318 or 319 facing the magnetically actuable latch 312.

Thus, the flexible element 316 of the locking mechanism 310 may bias the magnetically actuable latch 312 into the latch mating element recess 318B or 319B, such as shown, for example, in FIGS. 11-12. Such a configuration may prevent or provide resistance to movement of the handle assembly 390 along the pathways 354 and 356 of the bottom housing 350. Thus, the magnetically actuable latch 312, along with the top housing 370 and locking mechanism cover 380 as described above, may cooperate to prevent or provide resistance to movement, and thus removal, of the handle assembly 390 (and any security tag enclosed therein) from the rest of the CEM security device 302.

The runner 400 may include chamfered edges 406A and 406B, and the runner 410 may include chamfered edges 416A and 406B. These chamfered edges may facilitate sliding the runners 400 and 410 into and/or out of the pathways 354 and 356, respectively.

Referring to FIG. 15, the upper assembly 390B of the handle assembly 390 may include a top surface 430. The top surface 430 may be at least partially flat, and may include one or more handles 432 and 434, which may facilitate pushing or pulling the handle assembly 390 along the pathways 354 and 356 of the bottom housing 350. In one embodiment, such as where the security tag includes one or more linear amorphous resonators 394 as described above, the upper assembly 390B may include a slot 442 within which a magnetized bias 440 may be positioned.

The lower assembly 390A and upper assembly 390B may be secured together by welding or other another way such that the security tag, which may include one or more linear amorphous resonators 394 and a magnetized bias 440 in one embodiment, are enclosed and secured within the handle assembly 390.

Figure 16:
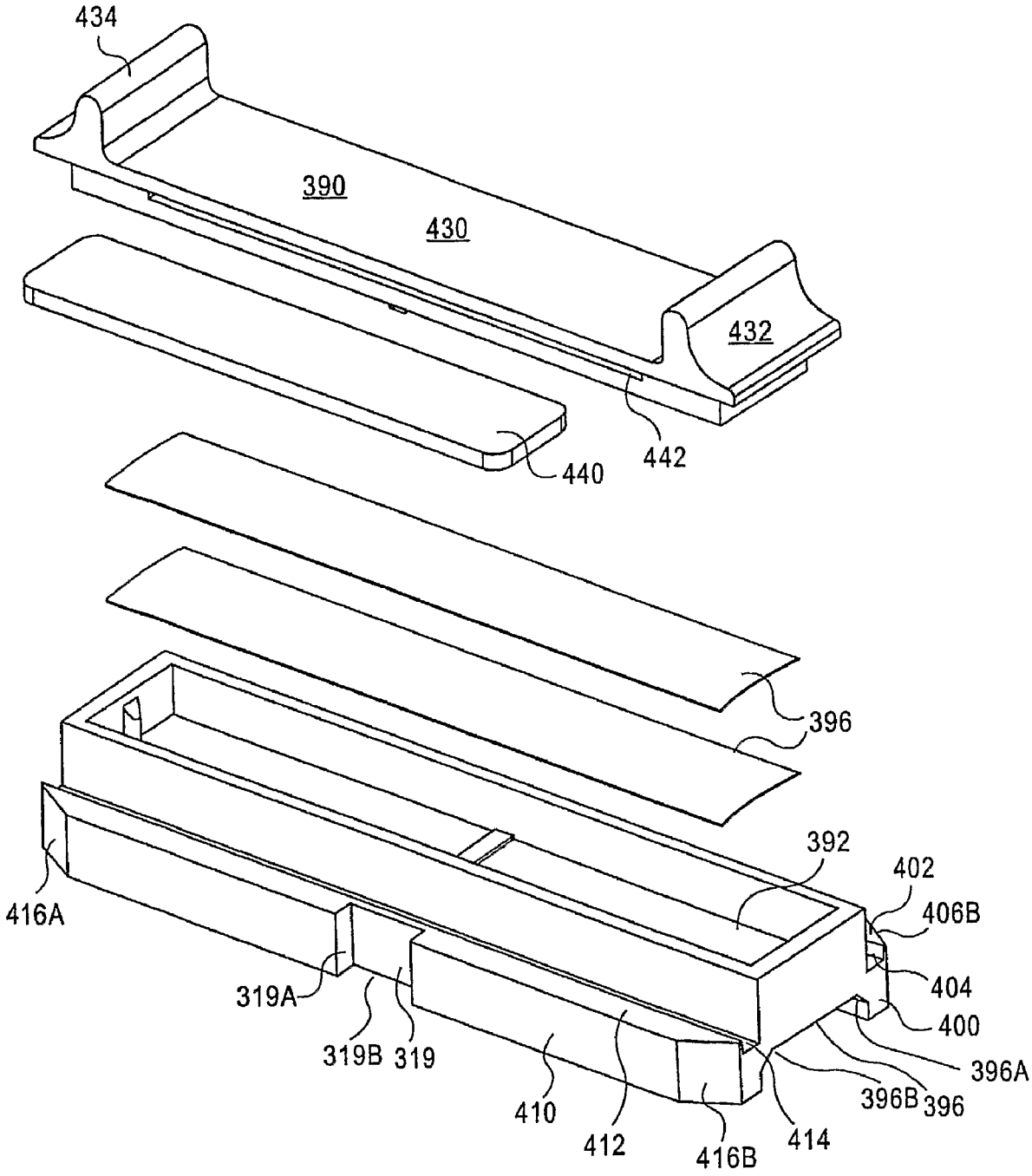
FIG. 16 illustrates an exploded view of a handle assembly of a CEM security device, in accordance with one embodiment.

FIG. 16 illustrates an exploded view of a handle assembly 390 that includes a security tag comprising linear amorphous resonators 394 and a magnetized bias 440, in accordance with one embodiment. In this embodiment, the handle assembly 390 comprises a lower assembly 390A, two linear amorphous resonators 394, a magnetized bias 440, and an upper assembly 390B.

In one embodiment, a CEM security device system includes the CEM security device 302 and a detacher, such as the detacher 40 described herein with respect to FIG. 1. Where the detacher 40 is placed near the magnetically actuable latch 312 of the security device 302 such that the flexible element 316 is positioned between the detacher 40 and magnetically actuable latch 312, the detacher 40 may magnetically force the magnetically actuable latch 312 out of the locking position and against the flexible element 316. If the magnetic force is greater than the compressive force of the flexible element 316 and any other forces resisting such movement of the magnetically actuable latch 312, the magnetically actuable latch 312 may move out of the locking position. In such case, the handle assembly 390 may not be blocked from sliding along the pathways 354 and 356, and may thus be slid off the CEM security device 302, exposing the CEM tunnel 360. Where the CEM is disposed therein, the CEM may be freely removed from the CEM security device 302.

Because no part of the CEM security device 302 in this embodiment may be broken to unlock it, the CEM security device 302 may be reusable. In another embodiment, the CEM security device 302 employs a magnetically actuable latch 312 or security tag that is for one-time use or is resettable.

In this embodiment, CEM security device 302 may be capable of holding an EAS tag and a magnetic mechanism and be for eyeglasses. The CEM security device 302 may, in one embodiment, carry an EAS component and may be utilized to provide resistance to or prevent the unauthorized from taking and then leaving a store with the eyeglasses security device and any pair of eyeglasses that may be partially enclosed or otherwise secured thereto. In one embodiment, this security device may include a bottom housing, top housing, latch mechanism cover, and EAS handle assembly or EAS assembly handle that may cooperate to lock the eyeglasses security device to a leg of the eyeglasses. The EAS handle assembly may include one or more linear amorphous resonators, a linear amorphous resonator housing, a magnetized bias, and a magnetized bias holder handle. In one embodiment, the EAS handle assembly may include three linear amorphous resonators In one embodiment, the CEM security device 302 may be configured such that the locking mechanism 310 may include the magnetic mechanism, and the security tag may include the EAS tag or EAS component. The security tag may include one or more linear amorphous resonators 394 and a magnetized bias 440, which may include the magnetized bias. In one embodiment, security tag may include three linear amorphous resonators. The housing 330 may include portions comprising the bottom housing, top housing, latch mechanism cover, and EAS handle assembly, which portions may correspond to the bottom housing 350, top housing 370, locking mechanism cover 380, and handle assembly 390, respectively. The handle assembly 390 may include a lower assembly 390A, which may include the linear amorphous resonator housing, and an upper assembly, which may include the magnetized bias holder handle. The handle assembly 390 may include the linear amorphous resonators 394 and magnetized bias 440, which may correspond to the EAS handle assembly including the three linear amorphous resonators and magnetized bias.

In another embodiment, a CEM security device 502, such as described with respect to the embodiments of FIGS. 17-30, may include a locking mechanism 510, a security tag 520, and a housing 530. The CEM security device 502 may be locked or otherwise secured to a proximal leg portion of an eyeglasses leg or other CEM, such as described above with respect to the CEM security device 302.

FIGS. 17-20 illustrate various perspectives views of a CEM security device 502, in accordance with one embodiment, and may be referred to where a corresponding element thereof is discussed. The CEM security device 502 in this embodiment includes a housing 530 that may include various portions, such as a bottom housing 550, security tag cover 570, locking mechanism cover 580, and handle assembly 590, such as described below. Each portion may comprise one or more materials, such as described herein with respect to the CEM security device 302.

Figure 22:
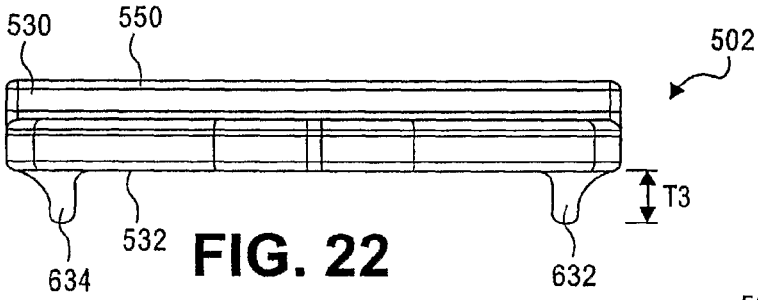
FIG. 22 illustrates a front view of a CEM security device, in accordance with one embodiment.
Figure 21:
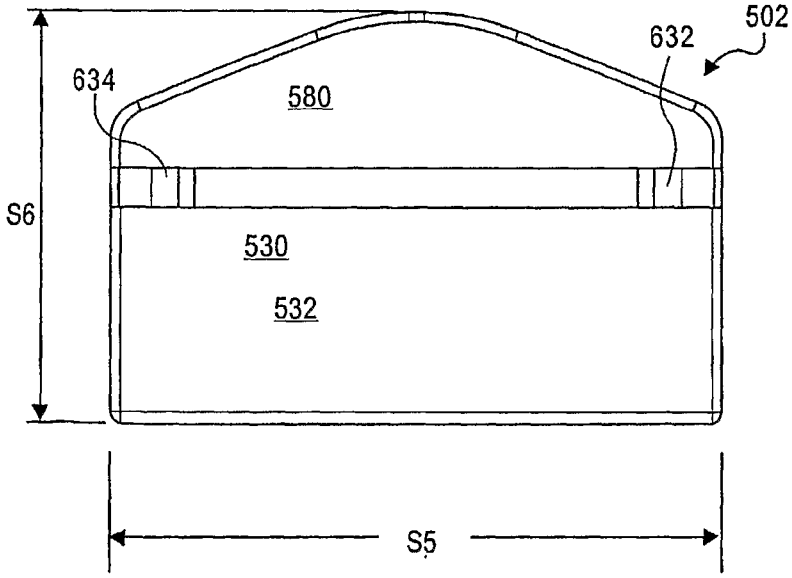
FIG. 21 illustrates a top view of a CEM security device, in accordance with one embodiment.
Figure 23:
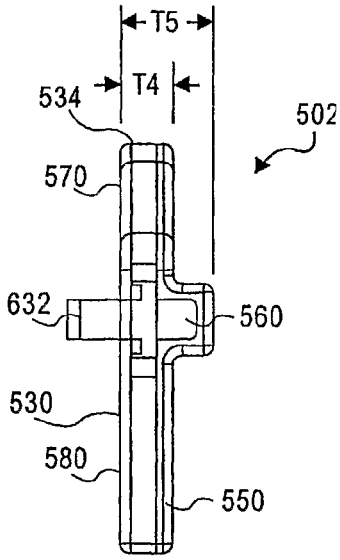
FIG. 23 illustrates a side view of a CEM security device, in accordance with one embodiment.

FIGS. 21-23 illustrate a top view, front view, and side view, respectively, of a CEM security device 502, in accordance with one embodiment. As shown in this embodiment, the housing 530, and thus the CEM security device 502, may have a top outer face 532 that is at least partially rectangular but with an outwardly bowed side 534, as viewed from the top view of FIG. 21. The top outer face 532 may include one or more protruding portions, the handles 632 and 634, which are described below. The housing 530 may have a slender thickness, which may be greatest in the vicinity of the handles 632 and 634. In one embodiment, the housing 530 has outer dimensions such that the top outer face 532 has the approximate side dimensions S5 and S6 of 48.85 mm and 33.17 mm, respectively, and the housing 530 has approximate thicknesses T3-T5 of 4.27 mm, 4.21 mm, and 7.41 mm, respectively. However, in various embodiments, the housing 530, and components thereof, may be sized and dimensioned as desired, such as described with respect to the housing 30 of the FIG. 1 embodiment, for example. The housing 530 may be configured, such as described herein, to secure the security tag 520 and a CEM thereto, and thus may lock the CEM security device 502 to the CEM, such as described below.

Figure 24:
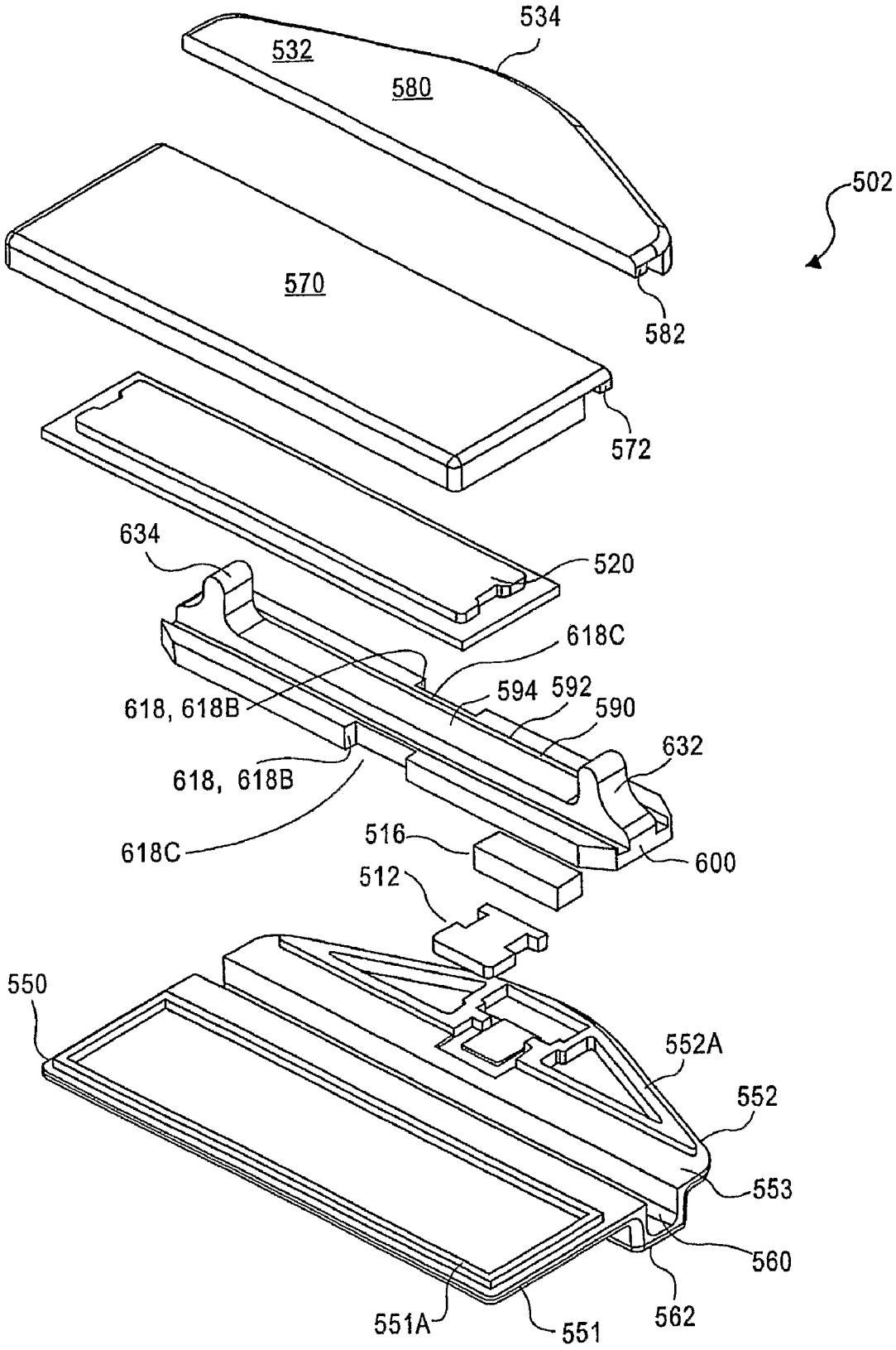
FIG. 24 illustrates an exploded view of a CEM security device, in accordance with one embodiment.

FIG. 24 illustrates an exploded view of a CEM security device 502, showing elements that may be included therewith, in accordance with one embodiment. This figure may be referred to where a corresponding element thereof is discussed.

Figure 25:
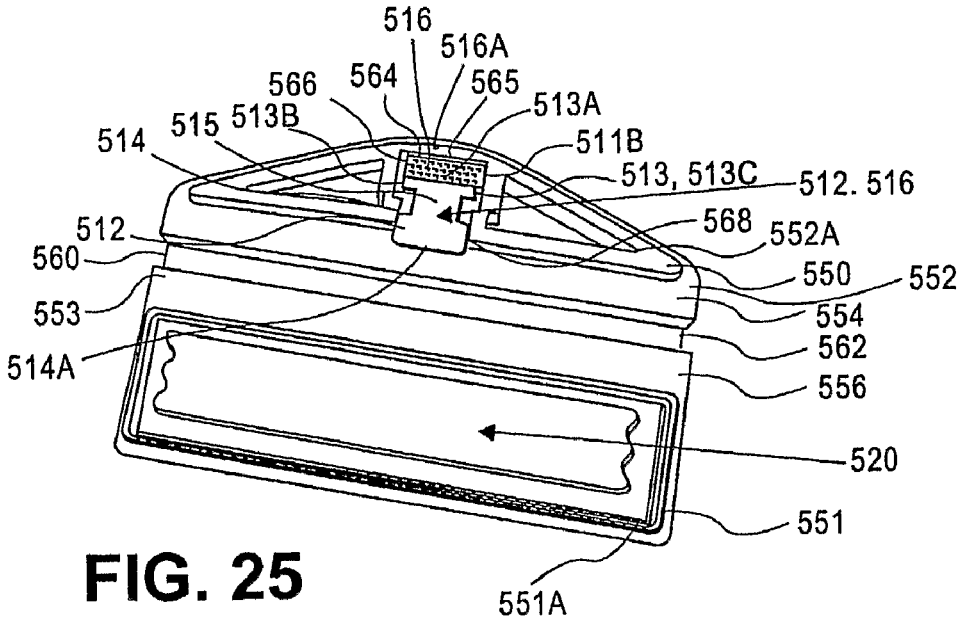
FIG. 25 illustrates a perspective view of a locking mechanism portion, bottom housing, and security tag of a CEM security device, in accordance with one embodiment.

FIG. 25 illustrates a perspective view of a locking mechanism 510 portion, security tag 520, and bottom housing 550 and of a CEM security device, in accordance with one embodiment. The locking mechanism 510 may include a magnetically actuable latch 512 and a flexible element 516.

The magnetically actuable latch 512 may comprise a magnetic material, and may comprise one or more materials such as described with respect to the magnetically actuable latch 12 of FIG. 1. The magnetically actuable latch 512 may include a base portion 513, which may include a base portion end 513A and base portion side surfaces 513B and 513C; a latching portion 514, which may include a latching portion end 514A; and a central portion 515.

The magnetically actuable latch 512 may be shaped like a capital "I". Thus, the base portion side surfaces 513B and 513C may be parallel and each may be at least substantially straight, and the width of the base portion 513, which may be the distance between base portion side surfaces 513B and 513C, may be substantially the same width as that of the latching portion 514, but wider than that of the central portion of the magnetically actuable latch 512. The base portion end 513A may be flat and may be substantially perpendicular to the base portion side surfaces 513B and 513C. The magnetically actuable latch 512 may be configured with a slender thickness. However, the magnetically actuable latch 512 may be otherwise configured in various embodiments, such as described herein with respect to the magnetically actuable latch 12 shown in FIG. 1. In addition, in one embodiment, the flexible element 516 may be combined or integrally formed with the magnetically actuable latch 512. In one embodiment, the flexible element 516 may be shaped as a cantilever arm, such as for example, a leaf spring.

The flexible element 516 may comprise or be formed of a flexible material, and may include a material or materials such as described herein with respect to the flexible element 16 shown in FIG. 1. The flexible element 516, in one embodiment, may be configured with a substantially cuboidal shape such that its side 516A is wider than its side 516B, or may have another shape. In various other embodiments, the flexible element 516 may be configured as, and comprise one or more materials of, a coil or other spring or like member, such as described above with respect to the magnetically actuable latch 12 of FIG. 1.

The one or more latch mating elements 518 and 519 may be integral with the housing 530 or a portion thereof and may each comprise a recess in the handle assembly 590, such as described below, or may be a separate piece or pieces.

The bottom housing 550 of the housing 530 may be configured such that the magnetically actuable latch 512 and flexible element 516 of the locking mechanism 510 may be adjacently disposed therein. Thus, the base portion end 513A of the magnetically actuable latch 512 may be positioned near or in abutment with the flexible element 516. With such a configuration, the movement of the magnetically actuable latch 512 and flexible element 516 may be restricted in one or more directions.

For example, the bottom housing 550 may include a channel end wall 565, channel walls 566 and 568, and a channel 564 delineated by channel walls 566 and 568 and may be bounded by the channel end wall 565. The channel walls 566 and 568 may include portions substantially parallel to each other, and may be positioned close to or in contact with the magnetically actuable latch 512 at the base portion side surfaces 513B and 513C and at the sides of the central and latching portions 515 and 514, respectively, thereby restricting the movement of the magnetically actuable latch 512 to movement along the channel 564, which may be movement in a substantially linear direction. The flexible element 516 may be positioned adjacent the channel end wall 565 such that where the magnetically actuable latch 512 is forced away from the locking position and against the flexible element 516, the flexible element 516 may compress by the force of the magnetically actuable latch 512 and the resistant force of the channel end wall 565. The flexible element 516 may provide a resistant force to such compression, against such movement of the magnetically actuable latch 512.

As described above, in each of various embodiments the magnetically actuable latch 512 may be configured with another shape, in which case the channel 564, and thus the channel walls 566 and 568, may be configured to accommodate such a magnetically actuable latch 512 and possibly restrict the movement of the magnetically actuable latch 512 in one or more directions. In each of these embodiments, the flexible element 516 may be configured to fit within the channel 564.

The bottom housing 550 of the housing 530 may be further or alternatively configured to receive a security tag cover 570, locking mechanism cover 580, and handle assembly 590, and a CEM. In one embodiment, the bottom housing 550 may include a security tag cover receiving portion 551, locking mechanism cover receiving portion 552, handle assembly receiving portion 553, and a CEM tunnel wall 562.

The security tag cover receiving portion 551 may include a top housing receiving wall 551A that may receive a similarly-shaped recess of the top housing 570. The cover receiving portion 551 may be alternatively configured based upon configuration of the top housing 570, or otherwise configured to receive the top housing 570. A security tag 520 may be disposed on the security tag cover receiving portion 551 and affixed thereto.

The locking mechanism cover receiving portion 552 may include a locking mechanism cover receiving wall 552A that may receive a similarly-shaped recess of the locking mechanism cover 580. The locking mechanism cover receiving portion 552 may be alternatively configured based upon the configuration of the locking mechanism cover 570, or otherwise configured to receive the locking mechanism cover 580.

The handle assembly receiving portion 553 may comprise ledges 554 and 556 on which the runner 600 of the handle assembly 590 may sit and may slide against, such as described below.

The CEM tunnel wall 562 may be "U" shaped or otherwise configured to receive a CEM. Where the runner 600 of the handle assembly 590 is disposed on the bottom housing 550 adjacent the CEM tunnel wall 562, as explained below, the CEM tunnel 560 may be delineated, and the CEM may be surrounded. In such case, the CEM may thus be blocked from removal, such as described herein. The CEM tunnel 560 may have a smaller cross-sectional area than that of the CEM tunnel 360 described in embodiments above.

Figure 26:
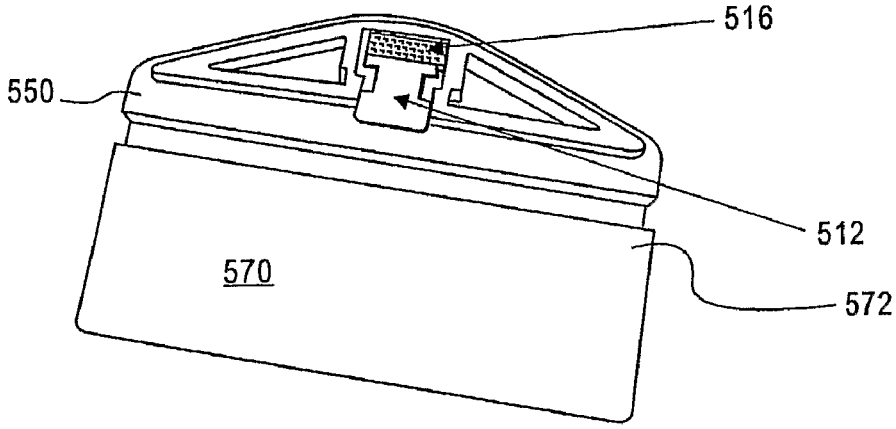
FIG. 26 illustrates a perspective view of a locking mechanism portion, bottom housing, and security tag cover of a CEM security device, in accordance with one embodiment.

FIG. 26 illustrates a perspective view of a locking mechanism 510 portion, bottom housing 550, and security tag cover 570 of a CEM security device 502, in accordance with one embodiment; The security tag cover 570 may be configured with a shape that is at least partially rectangular and/or a shape which may be similar to that of a portion of the housing 530. The security tag cover 570 may include a flange 572, which may be "L" shaped and may be to couple the security tag cover 570 with the handle assembly 590, such as explained below. The security tag cover 570 may have a slender thickness. However, in various embodiments, the security tag cover 570 may be otherwise or additionally configured, such as to receive the coupling wall 551A of the bottom housing 550 during connection. The top housing 570 may also or alternatively be secured to the bottom housing 550 by welding, fusing, gluing, snap-fit (such as where the bottom housing 550 and top housing 570 are configured with mating protrusions and voids, for example), interference fit, and/or by other securing means.

Referring back to FIG. 24, the locking mechanism cover 580 may be configured with a shape that is at least partially rectangular but with an outwardly bowed side 534 and may comprise the similarly-shaped portion of the outer face 532 of the housing 530, such as described herein with respect to the embodiment of FIG. 21. The locking mechanism cover 580 may include a flange 582, which may be "L" shaped and may be to couple with the handle assembly 590, as explained below. The flange 582 may have a shape similar to the flange 572 of the security tag cover 570.

The locking mechanism cover 580 may have a slender thickness. However, in various embodiments, the locking mechanism cover 580 may be otherwise configured to be secured to the bottom housing 550 and over the magnetically actuable latch 512 and flexible element 516 of the locking mechanism 510. The locking mechanism cover 580 may be secured to the bottom housing 550 by welding, fusing, gluing, snap-fit (such as where the bottom housing 550 and locking mechanism cover 580 are configured with mating protrusions and voids, for example), interference fit, and/or by other securing means. The locking mechanism cover 580 is also illustrated in the embodiments of FIGS. 17-20, for example, which may also be referred to with respect to this description.

Figure 27:
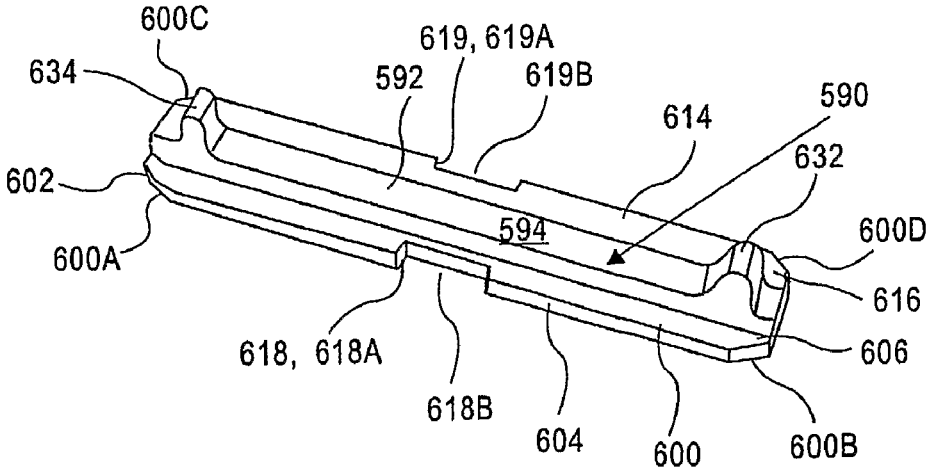
FIG. 27 illustrates a perspective view of a handle assembly, in accordance with one embodiment.

FIG. 27 illustrates a handle assembly 590, in accordance with one embodiment. The handle assembly 590 may be an elongated member comprising an upper portion 592 and a runner 600. In one embodiment, the handle assembly 590 is symmetrical. The upper portion 592 may project from the runner 600 and may comprise a top surface 594. The top surface 594 may comprise handles 632 and 634. Where the handle assembly 590 is disposed on the bottom housing 550, the handles 632 and 634 may facilitate sliding the handle assembly 590 over the ledges 554 and 556.

In other embodiments, the handle assembly 590 may be coupled with the bottom housing 550 by sliding, hinging, and/or a combination of sliding and hinging.

The runner 600 may be wider than the upper portion 592 and may include an undersurface, the base 602, which may be flat. The base 602 may be disposed on the ledges 554 and 556 of the bottom housing 550 such that it is adjacent the CEM tunnel wall 562 thereby, along with the CEM tunnel wall 562, delineating the CEM tunnel 560.

The runner 600 may include top walls 604 and 606 and adjacent coupling indents 614 and 616, respectively. With such a configuration, where the CEM security device 502 is assembled, the security tag cover 570 and locking mechanism cover 580 may be coupled with handle assembly 590. The flange 572 of the security tag cover 570 may extend over the top wall 606 and into the coupling indent 616 of the handle assembly 590, and the flange 582 of the locking mechanism cover 580 may extend over the top wall 604 and into the coupling indent 614 of the handle assembly 590. Such a configuration is shown, for example, in the embodiments of FIGS. 17-20 and 23. In various other embodiments, the security tag cover 570, locking mechanism cover 580, and the handle assembly 590 may be configured with different mating structures, such as with "L" shaped flanges as described herein with respect to the CEM security devices 302 and 702. With such a configuration as assembled, the security tag cover 570 and locking mechanism cover 580 may prevent or provide resistance to movement of the handle assembly 590, relative to the housing 530, in a direction other than a substantially linear direction along the ledges 554 and 556 of the bottom housing 550.

The runner 600 may include latch mating elements 518 and 519, which may be similarly configured. The latch mating element 618 may comprise a latch mating element wall 618A and a recess 618B or other void defined by the latch mating element wall 618A. The latch mating element 619 may have a similar configuration, with a latch mating element wall 619A and recess 619B.

The latch mating elements 618 and 619 may be positioned such that where the CEM security device 502 is assembled, one of the latch mating elements 618 and 619 is aligned with the magnetically actuable latch 512 of the locking mechanism 510. In one embodiment, the CEM security device 502 is symmetrical such that it may be disposed on the bottom housing 550, as described herein, with either latch mating element 618 or 619 facing the magnetically actuable latch 512. Thus, the flexible element 516 of the locking mechanism 510 may bias the magnetically actuable latch 512 into the latch mating element recess 518B or 519B, such as shown, for example, in FIGS. 28-29. Such a configuration may prevent or provide resistance to movement of the handle assembly 590 along the ledges 554 and 556 of the bottom housing 550. Thus, the magnetically actuable latch 512, along with the security tag cover 570 and locking mechanism 580 as described above, may cooperate to prevent or provide resistance to movement, and thus removal, of the handle assembly 590 from the rest of the CEM security device 502. Also, where a CEM extends through the CEM tunnel 560, the CEM security device 502 may be locked to the CEM.

The runner 600 may include chamfered edges 600A-600D. These chamfered edges 600A-600D may facilitate sliding the runners 600 into and/or out of the rest of housing 530.

Figure 28:
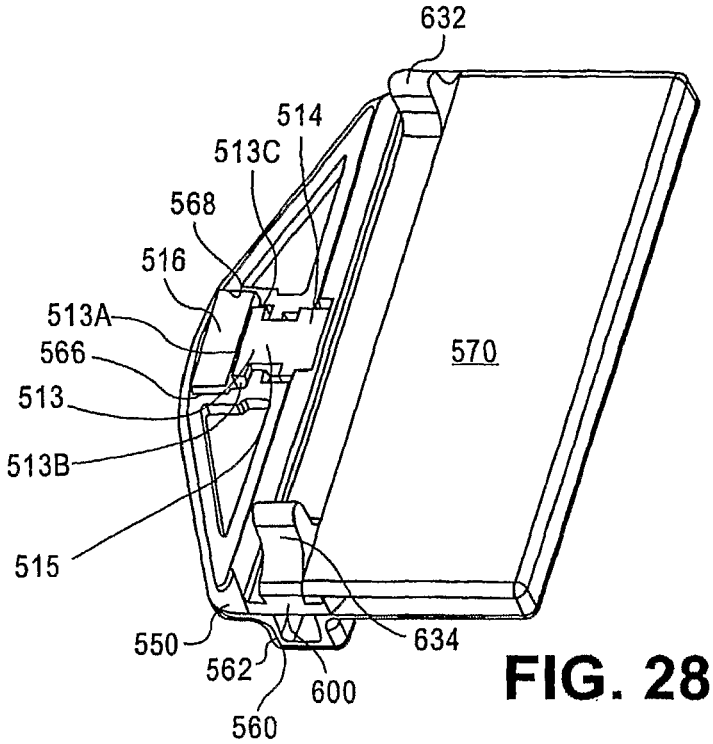
FIG. 28 illustrates a perspective view of a locking mechanism, bottom housing, security tag cover, and handle assembly of a CEM security device, in accordance with one embodiment.
Figure 29:
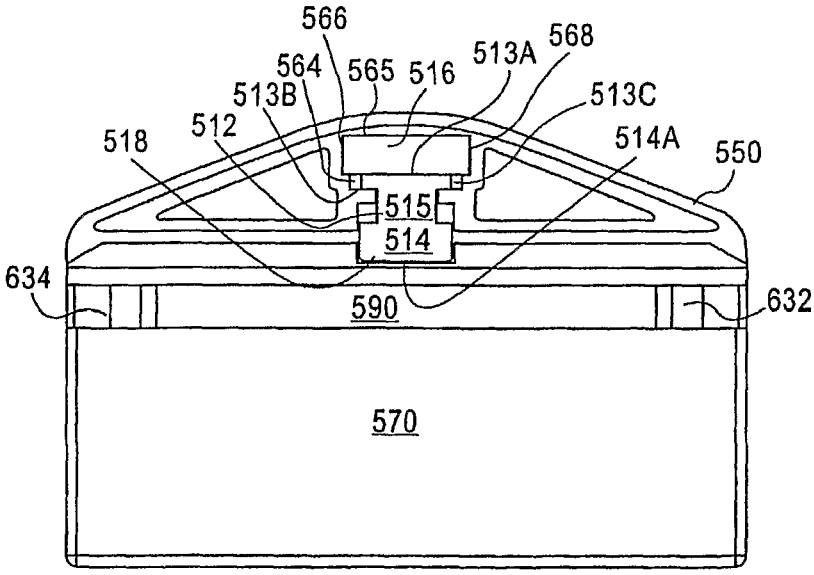
FIG. 29 illustrates a top view of a locking mechanism, bottom housing, security tag cover, and handle assembly of a CEM security device, in accordance with one embodiment.
Figure 30:
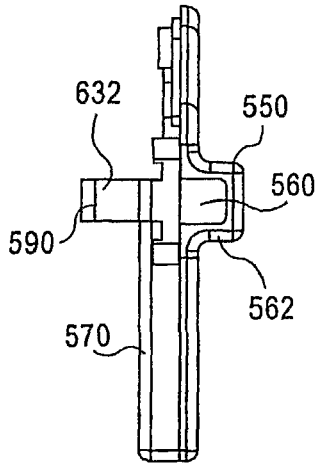
FIG. 30 illustrates a side view of a locking mechanism, bottom housing, security tag cover, and handle assembly of a CEM security device, in accordance with one embodiment.
Figure 31:
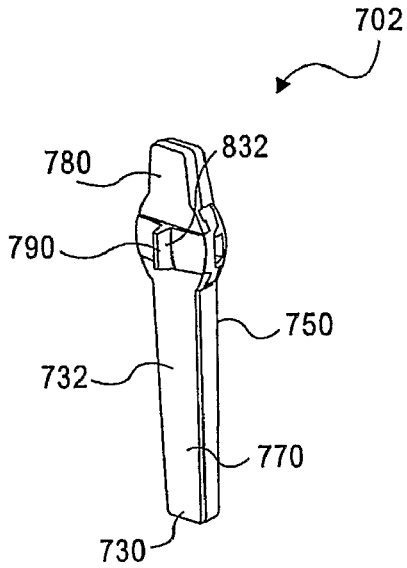
FIG. 31 illustrates a perspective view of a CEM security device, in accordance with one embodiment.
Figure 32:
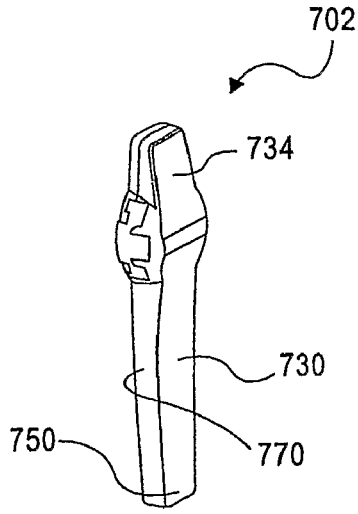
FIG. 32 illustrates a perspective view of a CEM security device, in accordance with one embodiment.
Figure 33:
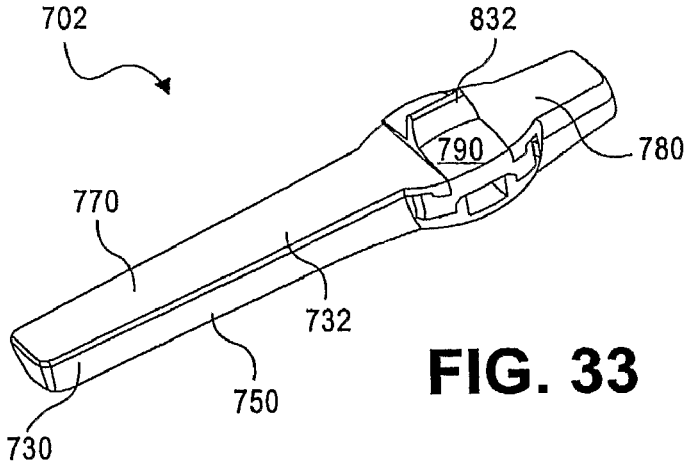
FIG. 33 illustrates a perspective view of a CEM security device, in accordance with one embodiment.
Figure 34:
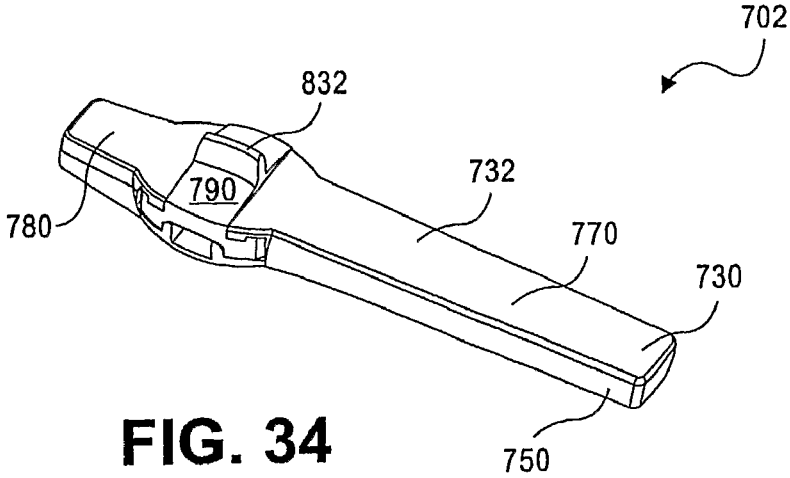
FIG. 34 illustrates a perspective view of a CEM security device, in accordance with one embodiment.

FIGS. 28-30 illustrate a perspective, top, and side view, respectively, of a locking mechanism 510, bottom housing 550, security tag cover 570, and handle assembly 590 of a CEM security device 502, in accordance with one embodiment. In this embodiment, the magnetically actuable latch 512 is shown extended into the latch mating element 518.

In one embodiment, a CEM security device system includes the CEM security device 502 and a detacher, such as the detacher 40 described herein with respect to FIG. 1. Where the detacher 40 is placed near the magnetically actuable latch 512 of the security device 502 such that the flexible element 516 is positioned between the detacher 40 and magnetically actuable latch 512, the detacher 40 may magnetically force the magnetically actuable latch 512 out of the locking position and against the flexible element 516. If the magnetic force is greater than the compressive force of the flexible element 516 and any other forces resisting such movement of the magnetically actuable latch 512, the magnetically actuable latch 512 may move out of the locking position. In such case, the handle assembly 590 may not be blocked from sliding along the ledges 554 and 556, and may thus be slid off the CEM security device 502, exposing the CEM tunnel 560. Where a CEM is disposed therein, the CEM may be freely removed from the CEM security device 502.

Because no part of the CEM security device 502 in this embodiment may be broken to unlock it, the CEM security device 502 may be reusable. In another embodiment, the CEM security device 502 employs a security tag 520 or magnetically actuable latch 512 that is for one-time use or is resettable.

In one embodiment, the CEM security device 502 may be called an eyeglasses security device assembly and may be reusable, resettable, or for one-time use. The CEM security device 502 may be capable of holding an EAS tag and a magnetic mechanism and be for eyeglasses. The CEM security device 502 may, in one embodiment, carry an EAS component and may be utilized to provide resistance to or prevent the unauthorized from taking and then leaving a store with the eyeglasses security device and any pair of eyeglasses that may be partially enclosed or otherwise secured thereto. In one embodiment, this security device may include a bottom housing, EAS label cover, latch mechanism cover, and EAS handle assembly that may cooperate to lock the eyeglasses security device to a leg of the eyeglasses. The EAS handle assembly may include one or more linear amorphous resonators, a linear amorphous resonator housing, a magnetized bias, and a magnetized bias holder handle. In one embodiment, the EAS handle assembly may include three linear amorphous resonators.

In one embodiment, the CEM security device 502 may be configured such that the locking mechanism 510 may include the magnetic mechanism, and the security tag 520 may include the EAS tag or EAS component. The security tag 520 may include linear amorphous resonators 394, which may include the one or more linear amorphous resonators, and a magnetized bias 440, which may include the magnetized bias. In one embodiment, the security tag 520 may include linear amorphous resonators 394. The housing 530 may include portions comprising the bottom housing, EAS label cover, latch mechanism cover, and track handle, which portions may correspond to the bottom housing 550, security tag cover 570, locking mechanism cover 580, and handle assembly 590, respectively.

In another embodiment, a CEM security device 702, such as described with respect to the embodiments of FIGS. 31-45, may include a locking mechanism 710, security tag 720, and housing 730. The CEM security device 702 may be locked or otherwise secured to a CEM.

FIGS. 31-35 illustrate various perspective views of the CEM security device 702, in accordance with one embodiment, and may be referred to where a corresponding element thereof is discussed. The CEM security device 702 in this embodiment includes a housing 730 that may include various portions, such as a bottom housing 750, security tag cover 770, locking mechanism cover 780, and handle assembly 790, such as described below. Each portion may comprise one or more materials, such as plastics and metals, and the portions may comprise the same or different materials, or a combination thereof.

Figure 37:
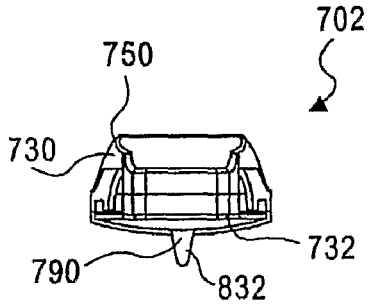
FIG. 37 illustrates a front view of a CEM security device, in accordance with one embodiment.
Figure 35:
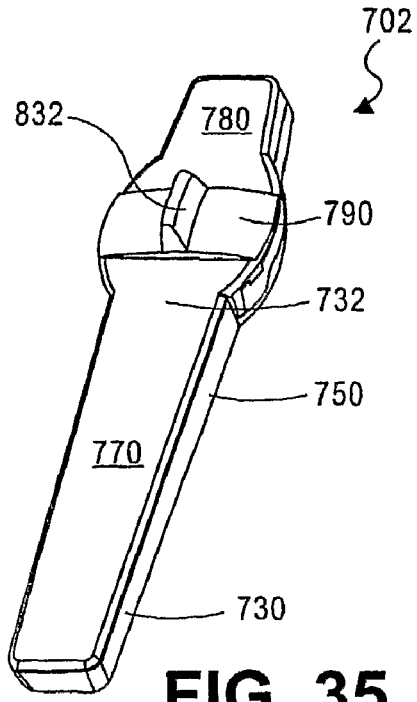
FIG. 35 illustrates a perspective view of a CEM security device, in accordance with one embodiment.
Figure 36:
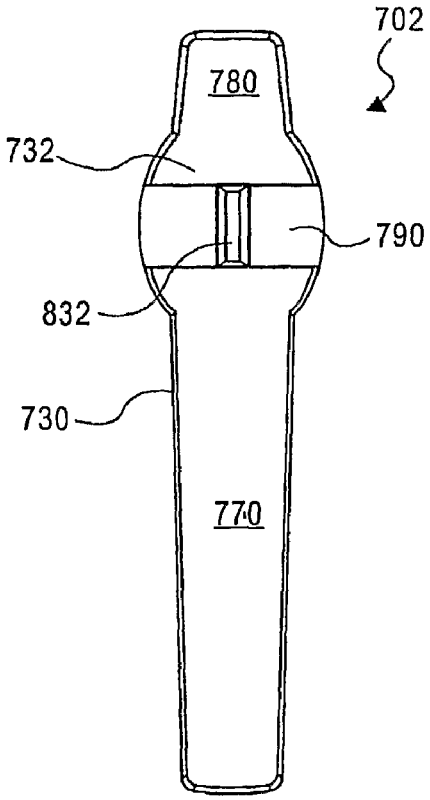
FIG. 36 illustrates a top view of a CEM security device, in accordance with one embodiment.
Figure 38:
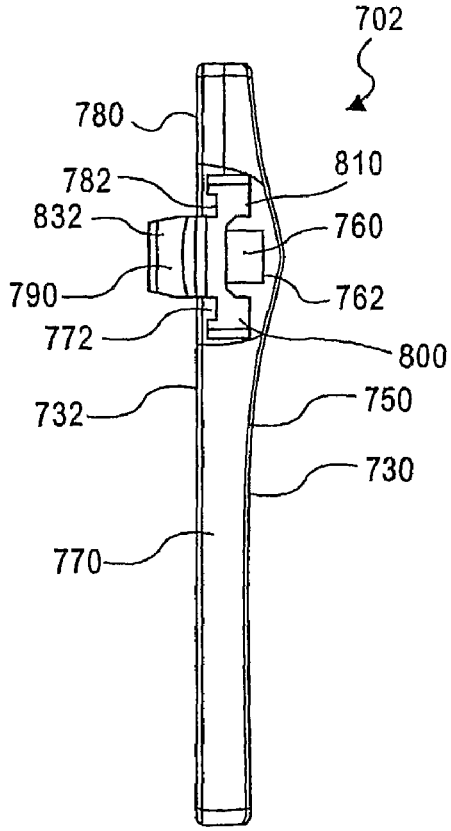
FIG. 38 illustrates a side view of a CEM security device, in accordance with one embodiment.
Figure 40:
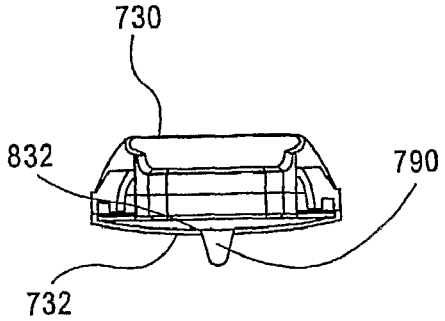
FIG. 40 illustrates a front view of a CEM security device, in accordance with one embodiment.
Figure 39:
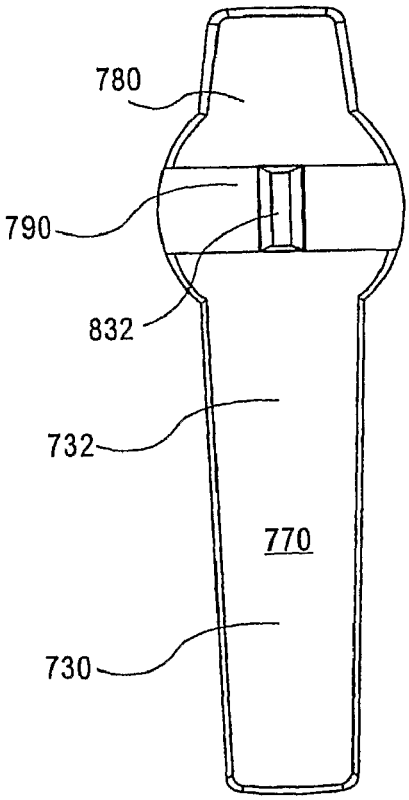
FIG. 39 illustrates a top view of a CEM security device, in accordance with one embodiment.
Figure 41:
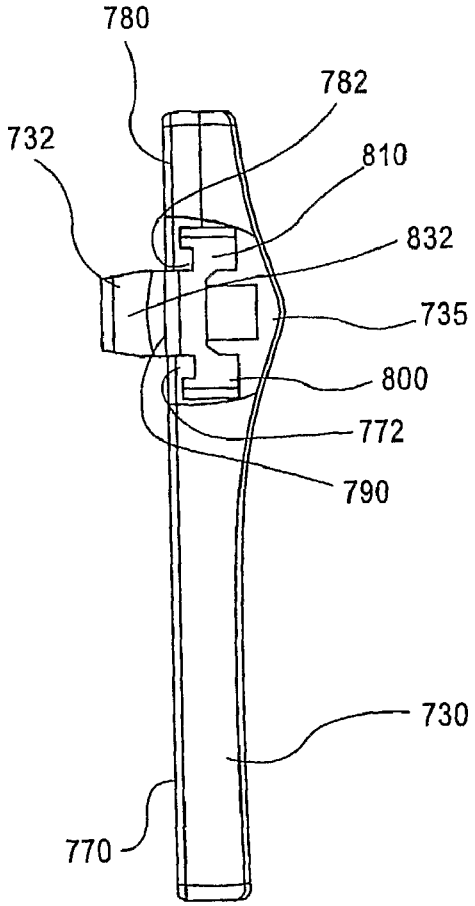
FIG. 41 illustrates a side view of a CEM security device, in accordance with one embodiment.

FIGS. 36-38 illustrate a top view, front view, and side view, respectively, of a CEM security device 702, in accordance with one embodiment. FIGS. 39-41 also respectively illustrates these views, respectively of an embodiment. Referring to FIGS. 36-41, the housing 730, and thus the CEM security device 702, may have a top outer face 732 that is at least partially shaped like a lowercase "I" but with concave edges and a bulged portion, as viewed from the top views of FIGS. 35 and 38. The top outer face 732 may include a protruding portion, which may be the handle 832 described below.

The housing 730, as viewed from the front views of FIGS. 37 and 40, may have may have one or more curved edges, and the profile of the top outer face 732 may be wider than that of its opposing face. As viewed from FIGS. 38 and 41, the housing 730 may include a slender thickness, which may be greatest in the vicinity of the handle 832. The housing 730 may have a bottom outer face 734, which may be at least partially flat but with a distended or otherwise protruding portion 735.

In one embodiment, the housing 730 has outer dimensions such that the top outer face 332 has the approximate side dimensions S7-S9 of 8.04 mm, 15.41 mm, and 10.55 mm, respectively, and the housing 730 has approximate thicknesses T6-T9 of 8.58 mm, 11.4 mm, 4.52 mm, and 4.35 mm, respectively.

However, in various embodiments, the housing 730, and components thereof, may be sized and dimensioned as desired, such as described with respect to the housing 30 of the FIG. 1 embodiment, for example. The housing 730 may be configured, such as described herein, to secure the security tag 720 and a CEM thereto, and thus may lock the CEM security device 702 to the CEM, such as described below.

Figure 42:
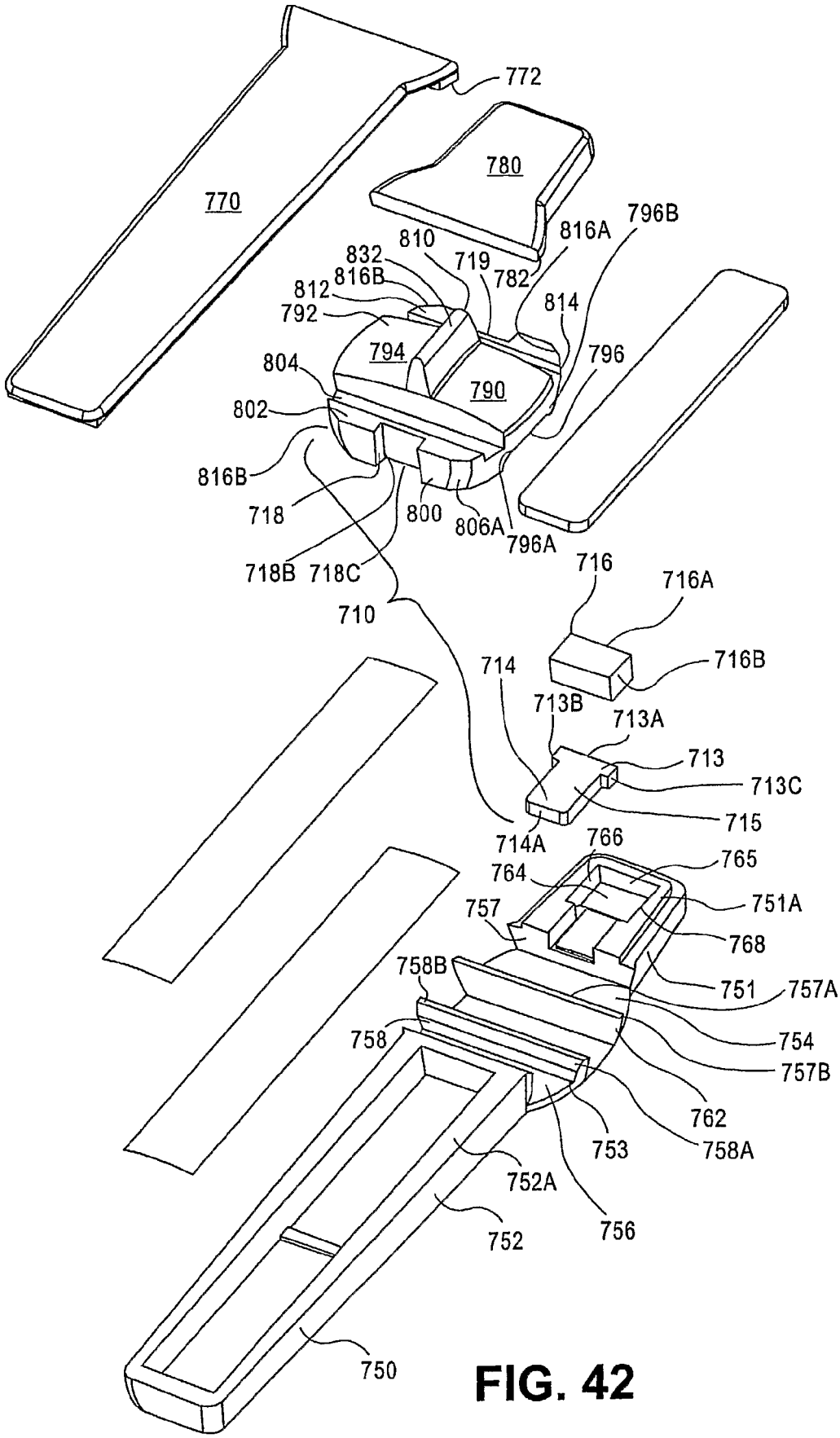
FIG. 42 illustrates an exploded view of a CEM security device, in accordance with one embodiment.

FIG. 42 illustrates an exploded view of an CEM security device 702, showing elements that may be included in the locking mechanism 710, security tag 720, and housing 730, in accordance with one embodiment.

The locking mechanism 710 may include a magnetically actuable latch 712, a flexible element 716, and a latch mating element 718. The magnetically actuable latch 712 may comprise a magnetic material, and may comprise one or more materials such as described with respect to the magnetically actuable latch 12 of FIG. 1. The magnetically actuable latch 712 may include a base portion 713, which may include a base portion end 713A and base portion side surfaces 713B and 713C; a latching portion 714, which may include a latching portion end 714A; and a central portion 715.

The magnetically actuable latch 712 may be shaped like a "T". Thus, the base portion side surfaces 713B and 713C may be parallel and each may be at least substantially straight, and the width of the base portion 713, which may be the distance between base portion side surfaces 713B and 713C, may be wider than the other widths of the magnetically actuable latch 712. The base portion end 713A may be flat and may be substantially perpendicular to the base portion side surfaces 713B and 713C. The magnetically actuable latch 712 may be configured with a slender thickness. However, the magnetically actuable latch 712 may be otherwise configured in various embodiments, such as described herein with respect to the magnetically actuable latch 12 shown in FIG. 1.

The flexible element 716 may comprise or be formed of a flexible material, and may include a material or materials and/or elements, such as described herein with respect to the flexible element 16 shown in FIG. 1. The flexible element 716, in one embodiment, may be configured with a substantially cuboidal shape such that its side 716A is wider than its side 716B, or may have another shape. In various other embodiments, the flexible element 716 may be configured as, and comprise one or more materials of, a coil or other spring or like member, such as described above with respect to the magnetically actuable latch 12 of FIG. 1. In addition, in one embodiment, the flexible element 716 may be combined or integrally formed with the magnetically actuable latch 712. In one embodiment, the flexible element 716 may be shaped as a cantilever arm, such as for example, a leaf spring.

The latch mating element 718 may be integral with the housing 730 or a portion thereof and may comprise a recess in the handle assembly 790, such as described below, or may be a separate piece or pieces.

The bottom housing 750 of the housing 730 may be configured such that the magnetically actuable latch 712 and flexible element 716 of the locking mechanism 710 may be adjacently disposed therein. Thus, the base portion end 713A of the magnetically actuable latch 712 may be positioned near or in abutment with the flexible element 716. With such a configuration, the movement of the magnetically actuable latch 712 and flexible element 716 may be restricted in one or more directions.

For example, the bottom housing 750 may include a channel end wall 765, channel walls 766 and 768, and a channel 764 delineated by channel walls 766 and 768 and bounded by the channel end wall 765. The channel walls 766 and 768 may include portions substantially parallel to each other, and may be positioned close to or in contact with the magnetically actuable latch 712 at the base portion side surfaces 713B and 713C and at the sides of the central and latching portions 715 and 714, respectively, thereby restricting the movement of the magnetically actuable latch 712 to movement along the channel 764, which may be movement in a substantially linear direction. The flexible element 716 may be positioned adjacent the channel end wall 765 such that where the magnetically actuable latch 712 is forced away from the locking position and against the flexible element 716, the flexible element 716 may compress by the force of the magnetically actuable latch 712 and the resistant force of the channel end wall 765. The flexible element 716 may provide a resistant force to such compression, against such movement of the magnetically actuable latch 712.

As described above, in each of various embodiments the magnetically actuable latch 712 may be configured with another shape, in which case the channel 764, and thus the channel walls 766 and 768, may be configured to accommodate such a magnetically actuable latch 712 and possibly restrict the movement of the magnetically actuable latch 712 in one or more directions. In each of these embodiments, the flexible element 716 may be configured to fit within the channel 764.

The bottom housing 750 of the housing 730 may be further or alternatively configured to receive a security tag cover 770, locking mechanism cover 780, and handle assembly 790, and a CEM. In one embodiment, the bottom housing 750 may include a security tag cover receiving portion 751, locking mechanism cover receiving portion 752, handle assembly receiving portion 753, and a CEM tunnel wall 762.

The security tag cover receiving portion 751 may include a security tag cover receiving wall 751A that may receive a similarly-shaped recess of the security tag cover 770. The security tag cover receiving portion 751 may be alternatively configured based upon configuration of the security tag cover 770, or otherwise configured to receive security tag cover housing 770.

The locking mechanism cover receiving portion 752 may include a locking mechanism cover receiving wall 752A that may receive a similarly-shaped recess of the locking mechanism cover 780. The locking mechanism cover receiving portion 752 may be alternatively configured based upon the configuration of the locking mechanism cover 780, or otherwise configured to receive the locking mechanism cover 780.

The security tag assembly receiving portion 753 may comprise pathways 754 and 756 through which runners 700 and 710 of the handle assembly 790 may respectively extend, such as described below. The pathways 754 and 756 may comprise voids delineated by pathway walls 757 and 758, respectively. The pathway walls 757 and 758 may be at least partially "U" shaped, and may further comprise chamfers 757A and 758A and top walls 757B and 758B, respectively. The CEM tunnel wall 762 may be "U" shaped or otherwise configured to receive a CEM. Where the CEM tunnel hood 796 of the handle assembly 790 is set adjacent the CEM tunnel wall 762 as explained below, the CEM tunnel 760 may be delineated and the CEM may thus be blocked from removal unless the CEM tunnel hood 796 is removed.

The security tag cover 770 may be configured with a shape that is at least partially rectangular with a flared portion and/or a shape which may be similar to that of a portion of the housing 730. The top housing 770 may include a flange 772, which may "L" shaped, such as shown in FIGS. 38, 41, and 42, and may be to couple the security tag cover 770 with the handle assembly 790, such as explained below. The top housing 770 may have a slender thickness. However, in various embodiments, the top housing 770 may be otherwise or additionally configured, such as to receive the coupling wall 751A of the bottom housing 750 during connection. The top housing 770 may also or alternatively be secured to the bottom housing 750 by welding, fusing, gluing, snap-fit (such as where the bottom housing 750 and top housing 770 are configured with mating protrusions and voids, for example), interference fit, and/or by other securing means.

The locking mechanism cover 780 may be configured with a shape that is at least partially rectangular but with a flared portion and may comprise the similarly-shaped portion of the outer face 732 of the housing 730. The locking mechanism cover 780 may include a flange 782, which may be "L" shaped and may be to couple with the handle assembly 790, as explained below. The flange 782 may have a shape similar to the flange 772 of the security tag cover 770.

The locking mechanism cover 780 may have a slender thickness. However, in various embodiments, the locking mechanism cover 780 may be otherwise configured to be secured to the bottom housing 750 and over the magnetically actuable latch 712 and flexible element 716 of the locking mechanism 710. The locking mechanism cover 780 may be secured to the bottom housing 750 by welding, fusing, gluing, snap-fit (such as where the bottom housing 750 and locking mechanism cover 780 are configured with mating protrusions and voids, for example), interference fit, and/or by other securing means.

The handle assembly 790 may be a compact member having an upper portion 792 and a lower portion 798. In one embodiment, the handle assembly 790 is symmetrical. The upper portion 792 may project from the lower portion and may comprise a top surface 794. The top surface 794 may comprise the handle 832. Where the handle assembly 790 is disposed on the bottom housing 750, the handle 832 may facilitate sliding the handle assembly 790 along the pathways 754 and 756.

In other embodiments, the handle assembly 790 may be coupled with the bottom housing 750 by sliding, hinging, and/or a combination of sliding and hinging.

The handle assembly 790 may include a recessed underside delineated by a CEM tunnel hood 796 that may be configured to fit over and adjacent the CEM tunnel wall 762 of the bottom housing 750, thereby, along with the CEM tunnel wall 762, delineating the CEM tunnel 760. The CEM tunnel hood 796 may be configured in a "U" shape but with chamfer mating surfaces 796A and 796B. With this configuration, the handle assembly 790 may be disposed on the bottom housing 750 such that the CEM tunnel hood 796 may be adjacent the top walls 757B and 758B, with the chamfer mating surfaces 796A and 796B adjacent the chamfers 757A and 758A. However, in various other embodiments, the CEM tunnel hood 796 and bottom housing 750 may be configured with a different mating arrangement.

The handle assembly 790 may include runners 800 and 810, which may include top walls 802 and 812 and adjacent coupling indents 804 and 814, respectively. With such a configuration, where the CEM security device 702 is assembled, the security tag cover 770 and locking mechanism cover 780 may be coupled with a runner 800 or 810. The flange 772 of the top housing 770 may extend over the top wall 812 and into the coupling indent 814 of the runner 810, and the flange 782 of the locking mechanism cover 780 may extend over the top wall 802 and into the coupling indent 804 of the runner 800, such as shown, for example, in the embodiments of FIGS. 38 and 41. In various other embodiments, the security tag cover 770, locking mechanism cover 780, and the handle assembly 790 may be configured with different mating structures, such as with straight, overlapping walls as described above with respect to the CEM security device 502, for example. With such a configuration as assembled, the top housing 770 and locking mechanism cover 780 may prevent or provide resistance to movement of the handle assembly 790 relative to the housing 730 in a direction other than along the pathways walls 754 and 756 of the bottom housing 750.

The runners 800 and 810 may include latch mating elements 718 and 719, respectively, which may be similarly configured. The latch mating element 718 may comprise a latch mating element wall 718A and a recess 7188B or other void defined by the latch mating element wall 718A. The latch mating element 719 may have a similar configuration as part of the runner 810, with a latch mating element wall 719A and recess 719B.

The latch mating elements 718 and 719 may be positioned such that where the CEM security device 702 is assembled, one of the latch mating elements 718 and 719 is aligned with the magnetically actuable latch 712 of the locking mechanism 710. In one embodiment, the CEM security device 702 is symmetrical such that it may be disposed on the bottom housing 750, as described herein, with either latch mating element 718 or 719 facing the magnetically actuable latch 712.

Thus, the flexible element 716 of the locking mechanism 710 may bias the magnetically actuable latch 712 into the latch mating element recess 718B or 719B (not shown). Such a configuration may prevent or provide resistance to movement of the handle assembly 790 along the pathways 754 and 756 of the bottom housing 750. Thus, the magnetically actuable latch 712, along with the security tag cover 770 and locking mechanism cover 780 as described above, may cooperate to prevent or provide resistance to movement, and thus removal, of the handle assembly 790 (and any security tag 720 enclosed therein) from the rest of the CEM security device 702. Also, where a CEM extends through the CEM tunnel 760, the CEM security device 702 may lock the CEM thereto.

The runner 800 may include chamfered edges 806A and 806B, and the runner 810 may include chamfered edges 816A and 806B. These chamfered edges may facilitate sliding the runners 800 and 810 into and/or out of the pathways 754 and 756, respectively.

In one embodiment, a CEM security device system includes the CEM security device 702 and a detacher, such as the detacher 40 described herein with respect to FIG. 1. Where the detacher 40 is placed near the magnetically actuable latch 712 of the security device 702 such that the flexible element 716 is positioned between the detacher 40 and magnetically actuable latch 712, the detacher 40 may magnetically force the magnetically actuable latch 712 out of the locking position and against the flexible element 716. If the magnetic force is greater than the compressive force of the flexible element 716 and any other forces resisting such movement of the magnetically actuable latch 712, the magnetically actuable latch 712 may move out of the locking position. In such case, the handle assembly 790 may not be blocked from sliding along the pathways 754 and 756, and may thus be slid off the CEM security device 702, exposing the CEM tunnel 760. Where the CEM is disposed therein, the CEM may be freely removed from the CEM security device 702.

Because no part of the CEM security device 702 in this embodiment may be broken to unlock it, the CEM security device 702 may be reusable. In another embodiment, the CEM security device 702 employs a security tag 720 or magnetically actuable latch 712 that is for one-time use or is resettable.

In one embodiment, the CEM security device 702 may be called a CEM security device assembly and may be reusable, resettable, or for one-time use. The CEM security device 702 may be capable of holding an EAS tag and a magnetic mechanism and be for eyeglasses. The CEM security device 702 may, in one embodiment, carry an EAS component and may be utilized to provide resistance to or prevent the unauthorized from taking and then leaving a store with the CEM security device and any pair of eyeglasses that may be partially enclosed or otherwise secured thereto. In one embodiment, this security device may include a bottom housing, top housing, latch mechanism cover, and EAS handle assembly that may cooperate to lock the CEM security device to a leg of the eyeglasses. The EAS handle assembly may include one or more linear amorphous resonators, a linear amorphous resonator housing, a magnetized bias, and a magnetized bias holder handle. In one embodiment, the EAS handle assembly may include three linear amorphous resonators.

In one embodiment, the CEM security device 702 may be configured such that the locking mechanism 710 may include the magnetic mechanism, and the security tag 720 may include the EAS tag or EAS component. The security tag 720 may include linear amorphous resonators 794, which may include the one or more linear amorphous resonators, and a magnetized bias 840, which may include the magnetized bias. In one embodiment, the security tag 720 may include three linear amorphous resonators. The housing 730 may include portions comprising the bottom housing, EAS label cover, latch mechanism cover, and track handle, which portions may correspond to the bottom housing 750, security tag cover 770, locking mechanism cover 780, and handle assembly 790, respectively.

While certain features of the embodiments have been illustrated as described herein, many modifications, substitutions, changes and equivalents will now occur to those skilled in the art. It is, therefore, to be understood that the appended claims are intended to cover all such modifications and changes as fall within the scope of the embodiments.

The invention claimed is:

1. A security device for an article having a constrained elongate member (CEM), comprising:

a magnetically actuable locking mechanism;

a security tag; and a housing comprising a top housing defining a tunnel extending through the housing and configuring for insertion of the CEM therethrough, the security tag and magnetically actuable locking mechanism secured to the housing, the magnetically actually locking mechanism preventing the removal of the CEM from the tunnel.

2. The security device of claim 1, wherein the magnetically actuable locking mechanism comprises a magnetically actuable latch, a flexible element, and a latch mating element.

3. The security device of claim 2, wherein the flexible element and the magnetically actuable latch are combined as a single piece.

4. The security device of claim 2, wherein the housing further comprises a channel, and wherein the magnetically actuable latch and flexible element are at least partially disposed in the channel.

5. The security device of claim 2, wherein the latch mating element is integral with the housing.

6. The security device of claim 2, wherein the latch mating element comprises a recess.

7. The security device of claim 6, wherein the flexible element is positioned adjacent the magnetically actuable latch and biases the magnetically actuable latch toward a locking position in which at least part of the magnetically actuable latch extends into the recess.

8. The security device of claim 2, wherein the magnetically actuable latch is positioned between the flexible element and the latch mating element.

9. The security device of claim 1, wherein the article having the CEM is a pair of eyeglasses.

10. The security device of claim 1, wherein the CEM is a proximal portion of a leg of the pair of eyeglasses.

11. The security device of claim 1, wherein the CEM is a member without ends.

12. The security device of claim 1, wherein the security device is reusable.

13. The security device of claim 1, wherein the security device is for one-time use.

14. The security device of claim 1, wherein the security device is resettable.

15. The locking mechanism of claim 1, wherein the magnetically actuable latch may be moved away from the locking position by magnetic force.

16. The locking mechanism of claim 15, wherein the magnetically actuable latch may be moved in a substantially linear direction.

17. The locking mechanism of claim 15, wherein the magnetically actuable latch may be moved in a substantially rotational direction.

18. The locking mechanism of claim 15, wherein the magnetically actuable latch may be moved in a combination of a rotational and linear direction.

19. A security device for an article having a constrained elongate member (CEM), comprising:

a security tag;

a magnetically actuable locking mechanism, the magnetically actuable locking mechanism comprising a magnetically actuable latch, a flexible element, and a latch receiving element; and a housing delineating a tunnel extending through the housing to receive the CEM, the security tag and magnetically actuable locking mechanism disposed in the housing, the housing comprising:

a bottom housing, and wherein the security tag and magnetically actuable locking mechanism are disposed in the bottom housing;

a handle assembly disposed on the bottom housing, the handle assembly and bottom housing delineating the tunnel, the handle assembly including at least one runner to slidably couple the handle assembly with the bottom housing, the at least one runner including a latch receiving element wherein the latch receiving element is aligned with the magnetically actuable latch in a locked position.

20. The security device of claim 19, wherein the handle assembly encloses the security tag.

21. The security device of claim 19 wherein the handle assembly is slidably and hingedly coupled with the bottom housing.

22. The security device of claim 19 wherein the security tag comprises one or more linear amorphous resonators and a magnetized bias.

23. The security device of claim 19 wherein the bottom housing comprises at least one pathway, and wherein the at least one runner may be moved along the at least one pathway when the security device is unlocked.

24. The security device of claim 19, wherein the bottom housing comprises at least one ledge, and wherein the at least one runner may be moved along the at least one ledge when the security device is unlocked.

25. The security device of claim 19, wherein the security tag is disposed in the bottom housing, the security device further comprising a security tag cover disposed over the security tag and on the bottom housing.

26. The security device of claim 19, wherein the housing further comprises a locking mechanism cover secured on the bottom housing and over the magnetically actuable latch and the flexible element.

27. The security device system for a constrained elongate member (CEM), comprising:

a security device comprising a housing including a top housing and a bottom housing defining a tunnel extending through the housing, the tunnel configured for insertion of the CEM therethrough;

a security tag and a magnetically actuable locking mechanism disposed in the housing, the magnetically actuable locking mechanism and the housing cooperating to prevent removal of the CEM from the tunnel;

and a detacher to unlock the security device, the detacher comprising a magnet.

* * * * *